US012203212B2

(12) United States Patent
Liu et al.

(10) Patent No.: US 12,203,212 B2
(45) Date of Patent: Jan. 21, 2025

(54) REGULATION METHOD OF EASY DYEING FOR PATTERNING FOUR-COMPONENT CHENILLE CARPET PILE

(71) Applicant: JINHUA JIELING HOUSE WARES CO., LTD., Jinhua (CN)

(72) Inventors: Qunhao Liu, Jinhua (CN); Shulan Jin, Jinhua (CN)

(73) Assignee: JINHUA JIELING HOUSE WARES CO., LTD., Jinhua (CN)

( * ) Notice: Subject to any disclaimer, the term of this patent is extended or adjusted under 35 U.S.C. 154(b) by 409 days.

(21) Appl. No.: 17/882,646

(22) Filed: Aug. 8, 2022

(65) Prior Publication Data

US 2023/0014704 A1 Jan. 19, 2023

Related U.S. Application Data

(63) Continuation of application No. PCT/CN2021/108349, filed on Jul. 26, 2021.

(30) Foreign Application Priority Data

Jun. 29, 2021 (CN) ..... 202110726890.4

(51) Int. Cl.
*D06P 1/00* (2006.01)
*D06N 7/00* (2006.01)

(52) U.S. Cl.
CPC ..... *D06P 1/0032* (2013.01); *D06N 7/0065* (2013.01); *D06P 1/0096* (2013.01)

(58) Field of Classification Search
CPC .... D06P 1/0032; D06P 1/0096; D06N 7/0065
See application file for complete search history.

(56) References Cited

FOREIGN PATENT DOCUMENTS

| | | | | |
|---|---|---|---|---|
| CN | 103076291 A | | 5/2013 | |
| CN | 108914292 A | | 11/2018 | |
| CN | 110424082 A | | 11/2019 | |
| CN | 112562016 A | | 3/2021 | |
| CN | 112733079 A | | 4/2021 | |
| EP | 0091676 B1 | * | 6/1989 | ..... D03D 27/18 |

* cited by examiner

*Primary Examiner* — Amina S Khan
(74) *Attorney, Agent, or Firm* — Bayramoglu Law Offices LLC

(57) ABSTRACT

The regulation method of easy dyeing for patterning a four-component chenille carpet pile combines raw filaments with different dyeing properties to prepare chenille yarns, and changes the combination modes and ratios of the raw filaments to prepare a four-component chenille carpet pile. The method realizes the heterochromaticity of the four-component pile through the uneven distribution of different dyes on the four-component raw filaments, and regulates the color difference of the four-component filaments after dyeing to form patterns with hazy, moderate and clear color mixing effects. The mixing of different colors dyed on the fibers in the four-component chenille carpet pile is spatial juxtaposition mixing, which forms a non-uniform and constant mixed color. According to the different mixing ratios of the color fibers and the interaction between the fiber hues, a composite color consisting of dominant and secondary hues is produced, thereby presenting a dynamic color.

5 Claims, 5 Drawing Sheets

| SN | Patterns | Combinations of piles | Arrangement of piles | Tufting process |
|---|---|---|---|---|
| 1 | 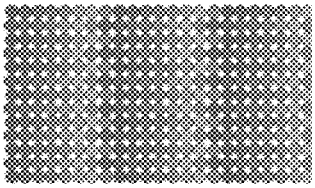 | Column A pile: $3A_1+1A_2+1A_3+1A_5$<br>Column B pile: $2A_1+2A_2+1A_3+1A_5$<br>Column C pile: $1A_1+3A_2+1A_3+1A_5$<br>Column D pile: $1A_1+2A_2+2A_3+1\ A_5$<br>Column E pile: $1A_1+1A_2+3A_3+1A_5$<br>Column F pile: $1A_1+1A_2+2A_3+2A_5$<br>Column G pile: $1A_1+1A_2+1A_3+3\ A_5$<br>Column H pile: $2A_1+1A_2+1A_3+2\ A_5$ | 1A+1B+1C+1D+1E +1F+1G+1H | Zigzag tufting process, where a needle is moved to the left to tuft for one stitch, and turn to the right from to tuft for one stitch |
| 2 | 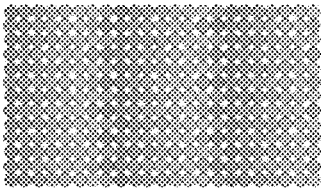 | Column A pile: $3A_2+1A_3+1A_4+1A_6$<br>Column B pile: $2A_2+2A_3+1A_4+1A_6$<br>Column C pile: $1A_2+3A_3+1A_4+1A_6$<br>Column D pile: $1A_2+2A_3+2A_4+1\ A_6$<br>Column E pile: $1A_2+1A_3+3A_4+1A_6$<br>Column F pile: $1A_2+1A_3+2A_4+2A_6$<br>Column G pile: $1A_2+1A_3+1A_4+3\ A_6$<br>Column H pile: $2A_2+1A_3+1A_4+2\ A_6$ | 1A+1B+1C+1D+1E +1F+1G+1H | Zigzag tufting process, where a needle is moved to the left to tuft for one stitch, and turn to the right from to tuft for one stitch |
| 3 | 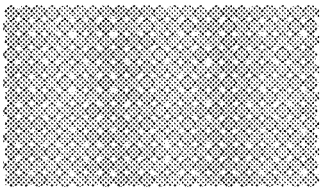 | Column A pile: $3A_3+1A_4+1A_5+1A_7$<br>Column B pile: $2A_3+2A_4+1A_5+1A_7$<br>Column C pile: $1A_3+3A_4+1A_5+1A_7$<br>Column D pile: $1A_3+2A_4+2A_5+1\ A_7$<br>Column E pile: $1A_3+1A_4+3A_5+1A_7$<br>Column F pile: $1A_3+1A_4+2A_5+2A_7$<br>Column G pile: $1A_3+1A_4+1A_5+3\ A_7$<br>Column H pile: $2A_3+1A_4+1A_5+2\ A_7$ | 1A+1B+1C+1D+1E +1F+1G+1H | Zigzag tufting process, where a needle is moved to the left to tuft for one stitch, and turn to the right from to tuft for one stitch |

FIG. 3

| SN | Patterns | Combinations of piles | Arrangement of piles | Tufting process |
|---|---|---|---|---|
| 1 | 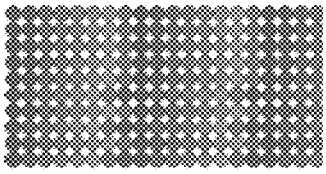 | Column A pile: $3A_1+1A_2+1A_3+1A_8$<br>Column B pile: $2A_1+2A_2+1A_3+1A_8$<br>Column C pile: $1A_1+3A_2+1A_3+1A_8$<br>Column D pile: $1A_1+2A_2+2A_3+1A_8$<br>Column E pile: $1A_1+1A_2+3A_3+1A_8$<br>Column F pile: $1A_1+1A_2+2A_3+2A_8$<br>Column G pile: $1A_1+1A_2+1A_3+3A_8$<br>Column H pile: $2A_1+1A_2+1A_3+2A_8$ | 1A+1B+1C+1D+1E +1F+1G+1H | Start from straight line tufting for 5 stitches; turn to zigzag tufting for 5 stitches from the 6th stitch; and return to straight line tufting from the 6th stitch |
| 2 | 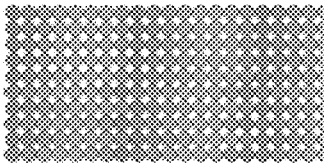 | Column A pile: $3A_2+1A_3+1A_4+1A_9$<br>Column B pile: $2A_2+2A_3+1A_4+1A_9$<br>Column C pile: $1A_2+3A_3+1A_4+1A_9$<br>Column D pile: $1A_2+2A_3+2A_4+1A_9$<br>Column E pile: $1A_2+1A_3+3A_4+1A_9$<br>Column F pile: $1A_2+1A_3+2A_4+2A_9$<br>Column G pile: $1A_2+1A_3+1A_4+3A_9$<br>Column H pile: $2A_2+1A_3+1A_4+2A_9$ | 1A+1B+1C+1D+1E +1F+1G+1H | Start from straight line tufting for 5 stitches; turn to zigzag tufting for 5 stitches from the 6th stitch; and return to straight line tufting from the 6th stitch |
| 3 | 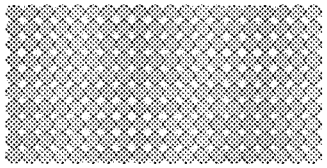 | Column A pile: $3A_3+1A_4+1A_5+1A_{10}$<br>Column B pile: $2A_3+2A_4+1A_5+1A_{10}$<br>Column C pile: $1A_3+3A_4+1A_5+1A_{10}$<br>Column D pile: $1A_3+2A_4+2A_5+1A_{10}$<br>Column E pile: $1A_3+1A_4+3A_5+1A_{10}$<br>Column F pile: $1A_3+1A_4+2A_5+2A_{10}$<br>Column G pile: $1A_3+1A_4+1A_5+3A_{10}$<br>Column H pile: $2A_3+1A_4+1A_5+2A_{10}$ | 1A+1B+1C+1D+1E +1F+1G+1H | Start from straight line tufting for 5 stitches; turn to zigzag tufting for 5 stitches from the 6th stitch; and return to straight line tufting from the 6th stitch |

FIG. 4

| SN | Patterns | Combinations of piles | Arrangement of piles | Tufting process |
|---|---|---|---|---|
| 1 | 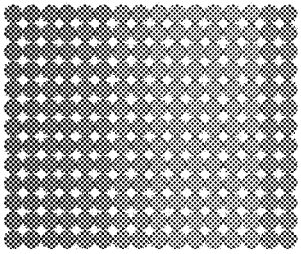 | Column A pile: $3A_1+1A_2+1A_4+1A_{13}$<br>Column B pile: $2A_1+2A_2+1A_4+1A_{13}$<br>Column C pile: $1A_1+3A_2+1A_4+1A_{13}$<br>Column D pile: $1A_1+2A_2+2A_4+1A_{13}$<br>Column E pile: $1A_1+1A_2+3A_4+1A_{13}$<br>Column F pile: $1A_1+1A_2+2A_4+2A_{13}$<br>Column G pile: $1A_1+1A_2+1A_4+3A_{13}$<br>Column H pile: $2A_1+1A_2+1A_4+2A_{13}$ | 2A+2B+2C+2D +2E+2F+2G+2H | Straight line tufting |
| 2 | 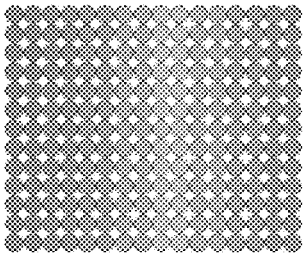 | Column A pile: $3A_2+1A_3+1A_5+1A_{14}$<br>Column B pile: $2A_2+2A_3+1A_5+1A_{14}$<br>Column C pile: $1A_2+3A_3+1A_5+1A_{14}$<br>Column D pile: $1A_2+2A_3+2A_5+1A_{14}$<br>Column E pile: $1A_2+1A_3+3A_5+1A_{14}$<br>Column F pile: $1A_2+1A_3+2A_5+2A_{14}$<br>Column G pile: $1A_2+1A_3+1A_5+3A_{14}$<br>Column H pile: $2A_2+1A_3+1A_5+2A_{14}$ | 2A+2B+2C+2D +2E+2F+2G+2H | Straight line tufting |
| 3 | 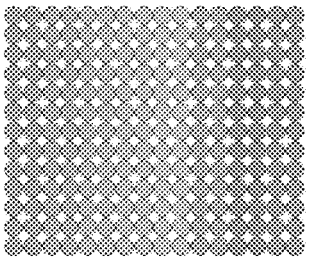 | Column A pile: $3A_3+1A_4+1A_6+1A_{15}$<br>Column B pile: $2A_3+2A_4+1A_6+1A_{15}$<br>Column C pile: $1A_3+3A_4+1A_6+1A_{15}$<br>Column D pile: $1A_3+2A_4+2A_6+1A_{15}$<br>Column E pile: $1A_3+1A_4+3A_6+1A_{15}$<br>Column F pile: $1A_3+1A_4+2A_6+2A_{15}$<br>Column G pile: $1A_3+1A_4+1A_6+3A_{15}$<br>Column H pile: $2A_3+1A_4+1A_6+2A_{15}$ | 2A+2B+2C+2D +2E+2F+2G+2H | Straight line tufting |

FIG. 5

REGULATION METHOD OF EASY DYEING FOR PATTERNING FOUR-COMPONENT CHENILLE CARPET PILE

CROSS REFERENCE TO THE RELATED APPLICATIONS

This application is a continuation application of International Application No. PCT/CN2021/108349, filed on Jul. 26, 2021, which is based upon and claims priority to Chinese Patent Application No. 202110726890.4, filed on Jun. 29, 2021, the entire contents of which are incorporated herein by reference.

TECHNICAL FIELD

The present disclosure relates to a regulation method of easy dyeing for patterning a four-component chenille carpet pile, and belongs to the technical field of spinning chromatography.

BACKGROUND

A chenille carpet of a specific specification is fabricated by dyeing and after-finishing a tufted fabric formed by tufting a chenille yarn on a backing fabric, then gluing and fixing the tufted fabric to a carpet substrate, cutting, binding and sewing.

In the prior art, the chenille yarn is usually fabricated by spinning conventional low-stretch polyester filaments on a chenille spinning machine, the chenille yarn is tufted by a tufting loom to form a tufted fabric, and then the tufted fabric is subjected to high-temperature and high-pressure dyeing so as to dye the pile. After the dyeing, the tufted fabric is glued to the carpet substrate, and then the carpet substrate is cut, bound and sewn to form a chenille carpet of a specific specification.

The appearance color, feel and style of the chenille carpet depend on those of the chenille carpet pile. Therefore, the dyeing and after-finishing process of the pile is the key process for the fabrication of the chenille carpet. In the dyeing process, the pile is subjected to high-temperature disperse dyeing to achieve an expected color of the pile, and the pile is subjected to shrinkage and untwisting which are controlled through the high-temperature heat treatment to make the pile standing, full and soft.

The dyeing and after-finishing process of the chenille carpet requires a large amount of dyes, energy and water, and also discharges a large amount of sewage. In order to solve the problems of environmental pollution and energy consumption existing in the traditional dyeing process, it is urgent to realize waterless dyeing, precise toning and digital color blending of piles, so as to promote the rapid development of chenille carpets. In view of this, the following problems need to be solved.

1. In the prior art, the chenille pile is produced by a single raw material, and it cannot be patterned with hazy, moderate and clear color mixing effects by dyeing.

2. The color difference of multi-component fibers can be regulated by changing the mixing ratio of the multi-component fibers and the dyeing formula, so as to achieve the patterns with hazy, moderate and clear color mixing effects. However, there is no relevant report in the prior art.

SUMMARY

A technical problem to be solved by the present disclosure is to provide a regulation method of easy dyeing for patterning a four-component chenille carpet pile. The present disclosure combines raw filaments with different dyeing properties to prepare chenille yarns, and changes the combination modes and ratios of the raw filaments to prepare a four-component chenille carpet pile. The present disclosure realizes the heterochromaticity of the four-component pile through the uneven distribution of different dyes on the four-component raw filaments, and regulates the color difference of the four-component filaments after dyeing to form patterns with hazy, moderate and clear color mixing effects.

In order to solve the above technical problem, the present disclosure adopts the following technical solution: a regulation method of easy dyeing for patterning a four-component chenille carpet pile, including the following steps:

step A: providing four types of raw filaments α, β, γ, δ with equal linear densities and different dyeing properties; mixing the four types of raw filaments α, β, γ, δ to obtain multiple types of pile filaments with different combinations of specified numbers of raw filaments α, β, γ, δ, which form a four-component chenille carpet pile filament system; and proceeding to step B;

step B: dyeing, by four preset types of dyes that are respectively applicable to the raw filaments α, β, γ, δ with different dyeing properties and have different base colors, the multiple types of pile filaments with different combinations of specified numbers of raw filaments α, β, γ, δ, that is, dyeing the raw filaments α, β, γ, δ in the multiple types of pile filaments respectively; and proceeding to step C;

step C: calculating, based on red, green and blue (RGB) values ($R_\alpha$, $G_\alpha$, $B_\alpha$), ($R_\beta$, $G_\beta$, $B_\beta$), ($R_\gamma$, $G_\gamma$, $B_\gamma$) and ($R_\delta$, $G_\delta$, $B_\delta$) of the dyed raw filaments α, β, γ, δ in the multiple types of pile filaments with different combinations of specified numbers of raw filaments α, β, γ, δ, RGB values of the multiple types of pile filaments with different combinations of specified numbers of raw filaments α, β, γ, δ, that is, calculating RGB values ($R_\xi$, $G_\xi$, $B_\xi$) of a chenille carpet pile ξ corresponding to different combinations of specified numbers of raw filaments α, β, γ, δ; and proceeding to step D; and step D: selecting combinations of four base colors with preset hue differences from preset base colors; dyeing, by the combinations of the four base colors, the raw filaments α, β, γ, δ in the multiple types of pile filaments respectively according to step B to obtain multiple types of mixed-color pile filaments with the preset hue differences; and constructing, based on the RGB values ($R_\xi$, $G_\xi$, $B_\xi$) of the chenille carpet pile ξ corresponding to different combinations of specified numbers of raw filaments α, β, γ, δ, preset types of chenille carpet piles by tufting the multiple types of mixed-color pile filaments with the preset hue differences.

In a preferred technical solution of the present disclosure, step A may include: providing four types of raw filaments α, β, γ, δ with equal linear densities and different dyeing properties, as shown in Table 1; and

TABLE 1

| | Numbers of raw filaments | | | | | | | | | | | |
|---|---|---|---|---|---|---|---|---|---|---|---|---|
| | 4 filaments | | | | 6 filaments | | | | 8 filaments | | | |
| Combinations | α | β | γ | δ | α | β | γ | δ | α | β | γ | δ |
| 1 | 1/4 | 1/4 | 1/4 | 1/4 | 3/6 | 1/6 | 1/6 | 1/6 | 5/8 | 1/8 | 1/8 | 1/8 |
| 2 | | | | | 2/6 | 2/6 | 1/6 | 1/6 | 4/8 | 2/8 | 1/8 | 1/8 |

TABLE 1-continued

| Combinations | Numbers of raw filaments | | | | | | | | | | | |
|---|---|---|---|---|---|---|---|---|---|---|---|---|
| | 4 filaments | | | | 6 filaments | | | | 8 filaments | | | |
| | α | β | γ | δ | α | β | γ | δ | α | β | γ | δ |
| 3 | | | | | 2/6 | 1/6 | 2/6 | 1/6 | 4/8 | 1/8 | 2/8 | 1/8 |
| 4 | | | | | 2/6 | 1/6 | 1/6 | 2/6 | 4/8 | 1/8 | 1/8 | 2/8 |
| 5 | | | | | 1/6 | 3/6 | 1/6 | 1/6 | 3/8 | 3/8 | 1/8 | 1/8 |
| 6 | | | | | 1/6 | 2/6 | 2/6 | 1/6 | 3/8 | 2/8 | 2/8 | 1/8 |
| 7 | | | | | 1/6 | 2/6 | 1/6 | 2/6 | 3/8 | 2/8 | 1/8 | 2/8 |
| 8 | | | | | 1/6 | 1/6 | 3/6 | 1/6 | 3/8 | 1/8 | 3/8 | 1/8 |
| 9 | | | | | 1/6 | 1/6 | 2/6 | 2/6 | 3/8 | 1/8 | 2/8 | 2/8 |
| 10 | | | | | 1/6 | 1/6 | 1/6 | 3/6 | 3/8 | 1/8 | 1/8 | 3/8 |
| 11 | | | | | | | | | 2/8 | 4/8 | 1/8 | 1/8 |
| 12 | | | | | | | | | 2/8 | 3/8 | 2/8 | 1/8 |
| 13 | | | | | | | | | 2/8 | 3/8 | 1/8 | 2/8 |
| 14 | | | | | | | | | 2/8 | 2/8 | 3/8 | 1/8 |
| 15 | | | | | | | | | 2/8 | 2/8 | 2/8 | 2/8 |
| 16 | | | | | | | | | 2/8 | 2/8 | 1/8 | 3/8 |
| 17 | | | | | | | | | 2/8 | 1/8 | 4/8 | 1/8 |
| 18 | | | | | | | | | 2/8 | 1/8 | 3/8 | 2/8 |
| 19 | | | | | | | | | 2/8 | 1/8 | 2/8 | 3/8 |
| 20 | | | | | | | | | 2/8 | 1/8 | 1/8 | 4/8 |
| 21 | | | | | | | | | 1/8 | 5/8 | 1/8 | 1/8 |
| 22 | | | | | | | | | 1/8 | 4/8 | 2/8 | 1/8 |
| 23 | | | | | | | | | 1/8 | 4/8 | 1/8 | 2/8 |

TABLE 1-continued

| Combinations | Numbers of raw filaments | | | | | | | | | | | |
|---|---|---|---|---|---|---|---|---|---|---|---|---|
| | 4 filaments | | | | 6 filaments | | | | 8 filaments | | | |
| | α | β | γ | δ | α | β | γ | δ | α | β | γ | δ |
| 24 | | | | | | | | | 1/8 | 3/8 | 3/8 | 1/8 |
| 25 | | | | | | | | | 1/8 | 3/8 | 2/8 | 2/8 |
| 26 | | | | | | | | | 1/8 | 3/8 | 1/8 | 3/8 |
| 27 | | | | | | | | | 1/8 | 2/8 | 4/8 | 1/8 |
| 28 | | | | | | | | | 1/8 | 2/8 | 3/8 | 2/8 |
| 29 | | | | | | | | | 1/8 | 2/8 | 2/8 | 3/8 |
| 30 | | | | | | | | | 1/8 | 2/8 | 1/8 | 4/8 |
| 31 | | | | | | | | | 1/8 | 1/8 | 5/8 | 1/8 |
| 32 | | | | | | | | | 1/8 | 1/8 | 4/8 | 2/8 |
| 33 | | | | | | | | | 1/8 | 1/8 | 3/8 | 3/8 |
| 34 | | | | | | | | | 1/8 | 1/8 | 2/8 | 4/8 |
| 35 | | | | | | | | | 1/8 | 1/8 | 1/8 | 5/8 |

mixing the four types of raw filaments α, β, γ, δ to obtain pile filaments with different combinations of specified numbers of raw filaments α, β, γ, δ, which form a four-component chenille carpet pile filament system.

In a preferred technical solution of the present disclosure, step C may include: based on Table 2,

TABLE 2

| Combinations | RGB values after combination | | |
|---|---|---|---|
| | $R_\xi$ | $G_\xi$ | $B_\xi$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |

calculating RGB values ($R_\xi$, $G_\xi$, $B_\xi$) of the chenille carpet pile corresponding to different combinations of 4 raw filaments α, β, γ, δ.

In a preferred technical solution of the present disclosure, step C may include: based on Table 3,

TABLE 3

| Combinations | RGB values after combination | | |
|---|---|---|---|
| | $R_\xi$ | $G_\xi$ | $B_\xi$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 2α + 2β + 1γ + 1δ | $\frac{2}{6}*R_\alpha+\frac{2}{6}*R_\beta+\frac{1}{6}*R_\gamma+\frac{1}{6}*R_\delta$ | $\frac{2}{6}*G_\alpha+\frac{2}{6}*G_\beta+\frac{1}{6}*G_\gamma+\frac{1}{6}*G_\delta$ | $\frac{2}{6}*B_\alpha+\frac{2}{6}*B_\beta+\frac{1}{6}*B_\gamma+\frac{1}{6}*B_\delta$ |
| 2α + 1β + 2γ + 1δ | $\frac{2}{6}*R_\alpha+\frac{1}{6}*R_\beta+\frac{2}{6}*R_\gamma+\frac{1}{6}*R_\delta$ | $\frac{2}{6}*G_\alpha+\frac{1}{6}*G_\beta+\frac{2}{6}*G_\gamma+\frac{1}{6}*G_\delta$ | $\frac{2}{6}*B_\alpha+\frac{1}{6}*B_\beta+\frac{2}{6}*B_\gamma+\frac{1}{6}*B_\delta$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 1α + 2β + 2γ + 1δ | $\frac{1}{6}*R_\alpha+\frac{2}{6}*R_\beta+\frac{2}{6}*R_\gamma+\frac{1}{6}*R_\delta$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 2β + 1γ + 2δ | $\frac{1}{6}*R_\alpha+\frac{2}{6}*R_\beta+\frac{1}{6}*R_\gamma+\frac{2}{6}*R_\delta$ | $\frac{1}{6}*G_\alpha+\frac{2}{6}*G_\beta+\frac{1}{6}*G_\gamma+\frac{2}{6}*G_\delta$ | $\frac{1}{6}*B_\alpha+\frac{2}{6}*B_\beta+\frac{1}{6}*B_\gamma+\frac{2}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |

TABLE 3-continued

| Combinations | RGB values after combination | | |
|---|---|---|---|
| | $R_\xi$ | $G_\xi$ | $B_\xi$ |
| $1\alpha + 1\beta + 2\gamma + 2\delta$ | $\frac{1}{6}*R_\alpha + \frac{1}{6}*R_\beta + \frac{2}{6}*R_\gamma + \frac{2}{6}*R_\delta$ | $\frac{1}{6}*G_\alpha + \frac{1}{6}*G_\beta + \frac{2}{6}*G_\gamma + \frac{2}{6}*G_\delta$ | $\frac{1}{6}*B_\alpha + \frac{1}{6}*B_\beta + \frac{2}{6}*B_\gamma + \frac{2}{6}*B_\delta$ |
| $1\alpha + 1\beta + 1\gamma + 3\delta$ | $\frac{1}{6}*R_\alpha + \frac{1}{6}*R_\beta + \frac{1}{6}*R_\gamma + \frac{3}{6}*R_\delta$ | $\frac{1}{6}*G_\alpha + \frac{1}{6}*G_\beta + \frac{1}{6}*G_\gamma + \frac{3}{6}*G_\delta$ | $\frac{1}{6}*B_\alpha + \frac{1}{6}*B_\beta + \frac{1}{6}*B_\gamma + \frac{3}{6}*B_\delta$ |

calculating RGB values ($R_\xi$, $G_\xi$, $B_\xi$) of the chenille carpet pile $\xi$ corresponding to different combinations of 6 raw filaments $\alpha$, $\beta$, $\gamma$, $\delta$.

In a preferred technical solution of the present disclosure, step C may include: based on Table 4,

TABLE 4

| Combinations | RGB values after combination | | |
|---|---|---|---|
| | $R_\xi$ | $G_\xi$ | $B_\xi$ |
| $5\alpha + 1\beta + 1\gamma + 1\delta$ | $\frac{5}{8}*R_\alpha + \frac{1}{8}*R_\beta + \frac{1}{8}*R_\gamma + \frac{1}{8}*R_\delta$ | $\frac{5}{8}*G_\alpha + \frac{1}{8}*G_\beta + \frac{1}{8}*G_\gamma + \frac{1}{8}*G_\delta$ | $\frac{5}{8}*B_\alpha + \frac{1}{8}*B_\beta + \frac{1}{8}*B_\gamma + \frac{1}{8}*B_\delta$ |
| $4\alpha + 2\beta + 1\gamma + 1\delta$ | $\frac{4}{8}*R_\alpha + \frac{2}{8}*R_\beta + \frac{1}{8}*R_\gamma + \frac{1}{8}*R_\delta$ | $\frac{4}{8}*G_\alpha + \frac{2}{8}*G_\beta + \frac{1}{8}*G_\gamma + \frac{1}{8}*G_\delta$ | $\frac{4}{8}*B_\alpha + \frac{2}{8}*B_\beta + \frac{1}{8}*B_\gamma + \frac{1}{8}*B_\delta$ |
| $4\alpha + 1\beta + 2\gamma + 1\delta$ | $\frac{4}{8}*R_\alpha + \frac{1}{8}*R_\beta + \frac{2}{8}*R_\gamma + \frac{1}{8}*R_\delta$ | $\frac{4}{8}*G_\alpha + \frac{1}{8}*G_\beta + \frac{2}{8}*G_\gamma + \frac{1}{8}*G_\delta$ | $\frac{4}{8}*B_\alpha + \frac{1}{8}*B_\beta + \frac{2}{8}*B_\gamma + \frac{1}{8}*B_\delta$ |
| $4\alpha + 1\beta + 1\gamma + 2\delta$ | $\frac{4}{8}*R_\alpha + \frac{1}{8}*R_\beta + \frac{1}{8}*R_\gamma + \frac{2}{8}*R_\delta$ | $\frac{4}{8}*G_\alpha + \frac{1}{8}*G_\beta + \frac{1}{8}*G_\gamma + \frac{2}{8}*G_\delta$ | $\frac{4}{8}*B_\alpha + \frac{1}{8}*B_\beta + \frac{1}{8}*B_\gamma + \frac{2}{8}*B_\delta$ |
| $3\alpha + 3\beta + 1\gamma + 1\delta$ | $\frac{3}{8}*R_\alpha + \frac{3}{8}*R_\beta + \frac{1}{8}*R_\gamma + \frac{1}{8}*R_\delta$ | $\frac{3}{8}*G_\alpha + \frac{3}{8}*G_\beta + \frac{1}{8}*G_\gamma + \frac{1}{8}*G_\delta$ | $\frac{3}{8}*B_\alpha + \frac{3}{8}*B_\beta + \frac{1}{8}*B_\gamma + \frac{1}{8}*$ |
| $3\alpha + 2\beta + 2\gamma + 1\delta$ | $\frac{3}{8}*R_\alpha + \frac{2}{8}*R_\beta + \frac{2}{8}*R_\gamma + \frac{1}{8}*R_\delta$ | $\frac{3}{8}*G_\alpha + \frac{2}{8}*G_\beta + \frac{2}{8}*G_\gamma + \frac{1}{8}*G_\delta$ | $\frac{3}{8}*B_\alpha + \frac{2}{8}*B_\beta + \frac{2}{8}*B_\gamma + \frac{1}{8}*B_\delta$ |
| $3\alpha + 2\beta + 1\gamma + 2\delta$ | $\frac{3}{8}*R_\alpha + \frac{2}{8}*R_\beta + \frac{1}{8}*R_\gamma + \frac{2}{8}*R_\delta$ | $\frac{3}{8}*G_\alpha + \frac{2}{8}*G_\beta + \frac{1}{8}*G_\gamma + \frac{2}{8}*G_\delta$ | $\frac{3}{8}*B_\alpha + \frac{2}{8}*B_\beta + \frac{1}{8}*B_\gamma + \frac{2}{8}*B_\delta$ |
| $3\alpha + 1\beta + 3\gamma + 1\delta$ | $\frac{3}{8}*R_\alpha + \frac{1}{8}*R_\beta + \frac{3}{8}*R_\gamma + \frac{1}{8}*R_\delta$ | $\frac{3}{8}*G_\alpha + \frac{1}{8}*G_\beta + \frac{3}{8}*G_\gamma + \frac{1}{8}*G_\delta$ | $\frac{3}{8}*B_\alpha + \frac{1}{8}*B_\beta + \frac{3}{8}*B_\gamma + \frac{1}{8}*B_\delta$ |
| $3\alpha + 1\beta + 2\gamma + 2\delta$ | $\frac{3}{8}*R_\alpha + \frac{1}{8}*R_\beta + \frac{2}{8}*R_\gamma + \frac{2}{8}*R_\delta$ | $\frac{3}{8}*G_\alpha + \frac{1}{8}*G_\beta + \frac{2}{8}*G_\gamma + \frac{2}{8}*G_\delta$ | $\frac{3}{8}*B_\alpha + \frac{1}{8}*B_\beta + \frac{2}{8}*B_\gamma + \frac{2}{8}*B_\delta$ |
| $3\alpha + 1\beta + 1\gamma + 3\delta$ | $\frac{3}{8}*R_\alpha + \frac{1}{8}*R_\beta + \frac{1}{8}*R_\gamma + \frac{3}{8}*R_\delta$ | $\frac{3}{8}*G_\alpha + \frac{1}{8}*G_\beta + \frac{1}{8}*G_\gamma + \frac{3}{8}*G_\delta$ | $\frac{3}{8}*B_\alpha + \frac{1}{8}*B_\beta + \frac{1}{8}*B_\gamma + \frac{3}{8}*B_\delta$ |
| $2\alpha + 4\beta + 1\gamma + 1\delta$ | $\frac{2}{8}*R_\alpha + \frac{4}{8}*R_\beta + \frac{1}{8}*R_\gamma + \frac{1}{8}*R_\delta$ | $\frac{2}{8}*G_\alpha + \frac{4}{8}*G_\beta + \frac{1}{8}*G_\gamma + \frac{1}{8}*G_\delta$ | $\frac{2}{8}*B_\alpha + \frac{4}{8}*B_\beta + \frac{1}{8}*B_\gamma + \frac{1}{8}*B_\delta$ |
| $2\alpha + 3\beta + 2\gamma + 1\delta$ | $\frac{2}{8}*R_\alpha + \frac{3}{8}*R_\beta + \frac{2}{8}*R_\gamma + \frac{1}{8}*R_\delta$ | $\frac{2}{8}*G_\alpha + \frac{3}{8}*G_\beta + \frac{2}{8}*G_\gamma + \frac{1}{8}*G_\delta$ | $\frac{2}{8}*B_\alpha + \frac{3}{8}*B_\beta + \frac{2}{8}*B_\gamma + \frac{1}{8}*B_\delta$ |
| $2\alpha + 3\beta + 1\gamma + 2\delta$ | $\frac{2}{8}*R_\alpha + \frac{3}{8}*R_\beta + \frac{1}{8}*R_\gamma + \frac{2}{8}*R_\delta$ | $\frac{2}{8}*G_\alpha + \frac{3}{8}*G_\beta + \frac{1}{8}*G_\gamma + \frac{2}{8}*G_\delta$ | $\frac{2}{8}*B_\alpha + \frac{3}{8}*B_\beta + \frac{1}{8}*B_\gamma + \frac{2}{8}*B_\delta$ |
| $2\alpha + 2\beta + 3\gamma + 1\delta$ | $\frac{2}{8}*R_\alpha + \frac{2}{8}*R_\beta + \frac{3}{8}*R_\gamma + \frac{1}{8}*R_\delta$ | $\frac{2}{8}*G_\alpha + \frac{2}{8}*G_\beta + \frac{3}{8}*G_\gamma + \frac{1}{8}*G_\delta$ | $\frac{2}{8}*B_\alpha + \frac{2}{8}*B_\beta + \frac{3}{8}*B_\gamma + \frac{1}{8}*B_\delta$ |
| $2\alpha + 2\beta + 2\gamma + 2\delta$ | $\frac{2}{8}*R_\alpha + \frac{2}{8}*R_\beta + \frac{2}{8}*R_\gamma + \frac{2}{8}*R_\delta$ | $\frac{2}{8}*G_\alpha + \frac{2}{8}*G_\beta + \frac{2}{8}*G_\gamma + \frac{2}{8}*G_\delta$ | $\frac{2}{8}*B_\alpha + \frac{2}{8}*B_\beta + \frac{2}{8}*B_\gamma + \frac{2}{8}*B_\delta$ |
| $2\alpha + 2\beta + 1\gamma + 3\delta$ | $\frac{2}{8}*R_\alpha + \frac{2}{8}*R_\beta + \frac{1}{8}*R_\gamma + \frac{3}{8}*R_\delta$ | $\frac{2}{8}*G_\alpha + \frac{2}{8}*G_\beta + \frac{1}{8}*G_\gamma + \frac{3}{8}*G_\delta$ | $\frac{2}{8}*B_\alpha + \frac{2}{8}*B_\beta + \frac{1}{8}*B_\gamma + \frac{3}{8}*B_\delta$ |
| $2\alpha + 1\beta + 4\gamma + 1\delta$ | $\frac{2}{8}*R_\alpha + \frac{1}{8}*R_\beta + \frac{4}{8}*R_\gamma + \frac{1}{8}*R_\delta$ | $\frac{2}{8}*G_\alpha + \frac{1}{8}*G_\beta + \frac{4}{8}*G_\gamma + \frac{1}{8}*G_\delta$ | $\frac{2}{8}*B_\alpha + \frac{1}{8}*B_\beta + \frac{4}{8}*B_\gamma + \frac{1}{8}*B_\delta$ |

TABLE 4-continued

| Combinations | RGB values after combination | | |
|---|---|---|---|
| | $R_\xi$ | $G_\xi$ | $B_\xi$ |
| 2α + 1β + 3γ + 2δ | $\frac{2}{8}*R_\alpha+\frac{1}{8}*R_\beta+\frac{3}{8}*R_\gamma+\frac{2}{8}*R_\delta$ | $\frac{2}{8}*G_\alpha+\frac{1}{8}*G_\beta+\frac{3}{8}*G_\gamma+\frac{2}{8}*G_\delta$ | $\frac{2}{8}*B_\alpha+\frac{1}{8}*B_\beta+\frac{3}{8}*B_\gamma+\frac{2}{8}*B_\delta$ |
| 2α + 1β + 2γ + 3δ | $\frac{2}{8}*R_\alpha+\frac{1}{8}*R_\beta+\frac{2}{8}*R_\gamma+\frac{3}{8}*R_\delta$ | $\frac{2}{8}*G_\alpha+\frac{1}{8}*G_\beta+\frac{2}{8}*G_\gamma+\frac{3}{8}*G_\delta$ | $\frac{2}{8}*B_\alpha+\frac{1}{8}*B_\beta+\frac{2}{8}*B_\gamma+\frac{3}{8}*B_\delta$ |
| 2α + 1β + 1γ + 4δ | $\frac{2}{8}*R_\alpha+\frac{1}{8}*R_\beta+\frac{1}{8}*R_\gamma+\frac{4}{8}*R_\delta$ | $\frac{2}{8}*G_\alpha+\frac{1}{8}*G_\beta+\frac{1}{8}*G_\gamma+\frac{4}{8}*G_\delta$ | $\frac{2}{8}*B_\alpha+\frac{1}{8}*B_\beta+\frac{1}{8}*B_\gamma+\frac{4}{8}*B_\delta$ |
| 1α + 5β + 1γ + 1δ | $\frac{1}{8}*R_\alpha+\frac{5}{8}*R_\beta+\frac{1}{8}*R_\gamma+\frac{1}{8}*R_\delta$ | $\frac{1}{8}*G_\alpha+\frac{5}{8}*G_\beta+\frac{1}{8}*G_\gamma+\frac{1}{8}*G_\delta$ | $\frac{1}{8}*B_\alpha+\frac{5}{8}*B_\beta+\frac{1}{8}*B_\gamma+\frac{1}{8}*B_\delta$ |
| 1α + 4β + 2γ + 1δ | $\frac{1}{8}*R_\alpha+\frac{4}{8}*R_\beta+\frac{2}{8}*R_\gamma+\frac{1}{8}*R_\delta$ | $\frac{1}{8}*G_\alpha+\frac{4}{8}*G_\beta+\frac{2}{8}*G_\gamma+\frac{1}{8}*G_\delta$ | $\frac{1}{8}*B_\alpha+\frac{4}{8}*B_\beta+\frac{2}{8}*B_\gamma+\frac{1}{8}*B_\delta$ |
| 1α + 4β + 1γ + 2δ | $\frac{1}{8}*R_\alpha+\frac{4}{8}*R_\beta+\frac{1}{8}*R_\gamma+\frac{2}{8}*R_\delta$ | $\frac{1}{8}*G_\alpha+\frac{4}{8}*G_\beta+\frac{1}{8}*G_\gamma+\frac{2}{8}*G_\delta$ | $\frac{1}{8}*B_\alpha+\frac{4}{8}*B_\beta+\frac{1}{8}*B_\gamma+\frac{2}{8}*B_\delta$ |
| 1α + 3β + 3γ + 1δ | $\frac{1}{8}*R_\alpha+\frac{3}{8}*R_\beta+\frac{3}{8}*R_\gamma+\frac{1}{8}*R_\delta$ | $\frac{1}{8}*G_\alpha+\frac{3}{8}*G_\beta+\frac{3}{8}*G_\gamma+\frac{1}{8}*G_\delta$ | $\frac{1}{8}*B_\alpha+\frac{3}{8}*B_\beta+\frac{3}{8}*B_\gamma+\frac{1}{8}*B_\delta$ |
| 1α + 3β + 2γ + 2δ | $\frac{1}{8}*R_\alpha+\frac{3}{8}*R_\beta+\frac{2}{8}*R_\gamma+\frac{2}{8}*R_\delta$ | $\frac{1}{8}*G_\alpha+\frac{3}{8}*G_\beta+\frac{2}{8}*G_\gamma+\frac{2}{8}*G_\delta$ | $\frac{1}{8}*B_\alpha+\frac{3}{8}*B_\beta+\frac{2}{8}*B_\gamma+\frac{2}{8}*B_\delta$ |
| 1α + 3β + 1γ + 3δ | $\frac{1}{8}*R_\alpha+\frac{3}{8}*R_\beta+\frac{1}{8}*R_\gamma+\frac{3}{8}*R_\delta$ | $\frac{1}{8}*G_\alpha+\frac{3}{8}*G_\beta+\frac{1}{8}*G_\gamma+\frac{3}{8}*G_\delta$ | $\frac{1}{8}*B_\alpha+\frac{3}{8}*B_\beta+\frac{1}{8}*B_\gamma+\frac{3}{8}*B_\delta$ |
| 1α + 2β + 4γ + 1δ | $\frac{1}{8}*R_\alpha+\frac{2}{8}*R_\beta+\frac{4}{8}*R_\gamma+\frac{1}{8}*R_\delta$ | $\frac{1}{8}*G_\alpha+\frac{2}{8}*G_\beta+\frac{4}{8}*G_\gamma+\frac{1}{8}*G_\delta$ | $\frac{1}{8}*B_\alpha+\frac{2}{8}*B_\beta+\frac{4}{8}*B_\gamma+\frac{1}{8}*B_\delta$ |
| 1α + 2β + 3γ + 2δ | $\frac{1}{8}*R_\alpha+\frac{2}{8}*R_\beta+\frac{3}{8}*R_\gamma+\frac{2}{8}*R_\delta$ | $\frac{1}{8}*G_\alpha+\frac{2}{8}*G_\beta+\frac{3}{8}*G_\gamma+\frac{2}{8}*G_\delta$ | $\frac{1}{8}*B_\alpha+\frac{2}{8}*B_\beta+\frac{3}{8}*B_\gamma+\frac{2}{8}*B_\delta$ |
| 1α + 2β + 2γ + 3δ | $\frac{1}{8}*R_\alpha+\frac{2}{8}*R_\beta+\frac{2}{8}*R_\gamma+\frac{3}{8}*R_\delta$ | $\frac{1}{8}*G_\alpha+\frac{2}{8}*G_\beta+\frac{2}{8}*G_\gamma+\frac{3}{8}*G_\delta$ | $\frac{1}{8}*B_\alpha+\frac{2}{8}*B_\beta+\frac{2}{8}*B_\gamma+\frac{3}{8}*B_\delta$ |
| 1α + 2β + 1γ + 4δ | $\frac{1}{8}*R_\alpha+\frac{2}{8}*R_\beta+\frac{1}{8}*R_\gamma+\frac{4}{8}*R_\delta$ | $\frac{1}{8}*G_\alpha+\frac{2}{8}*G_\beta+\frac{1}{8}*G_\gamma+\frac{4}{8}*G_\delta$ | $\frac{1}{8}*B_\alpha+\frac{2}{8}*B_\beta+\frac{1}{8}*B_\gamma+\frac{4}{8}*B_\delta$ |
| 1α + 1β + 5γ + 1δ | $\frac{1}{8}*R_\alpha+\frac{1}{8}*R_\beta+\frac{5}{8}*R_\gamma+\frac{1}{8}*R_\delta$ | $\frac{1}{8}*G_\alpha+\frac{1}{8}*G_\beta+\frac{5}{8}*G_\gamma+\frac{1}{8}*G_\delta$ | $\frac{1}{8}*B_\alpha+\frac{1}{8}*B_\beta+\frac{5}{8}*B_\gamma+\frac{1}{8}*B_\delta$ |
| 1α + 1β + 4γ + 2δ | $\frac{1}{8}*R_\alpha+\frac{1}{8}*R_\beta+\frac{4}{8}*R_\gamma+\frac{2}{8}*R_\delta$ | $\frac{1}{8}*G_\alpha+\frac{1}{8}*G_\beta+\frac{4}{8}*G_\gamma+\frac{2}{8}*G_\delta$ | $\frac{1}{8}*B_\alpha+\frac{1}{8}*B_\beta+\frac{4}{8}*B_\gamma+\frac{2}{8}*B_\delta$ |
| 1α + 1β + 3γ + 3δ | $\frac{1}{8}*R_\alpha+\frac{1}{8}*R_\beta+\frac{3}{8}*R_\gamma+\frac{3}{8}*R_\delta$ | $\frac{1}{8}*G_\alpha+\frac{1}{8}*G_\beta+\frac{3}{8}*G_\gamma+\frac{3}{8}*G_\delta$ | $\frac{1}{8}*B_\alpha+\frac{1}{8}*B_\beta+\frac{3}{8}*B_\gamma+\frac{3}{8}*B_\delta$ |
| 1α + 1β + 2γ + 4δ | $\frac{1}{8}*R_\alpha+\frac{1}{8}*R_\beta+\frac{2}{8}*R_\gamma+\frac{4}{8}*R_\delta$ | $\frac{1}{8}*G_\alpha+\frac{1}{8}*G_\beta+\frac{2}{8}*G_\gamma+\frac{4}{8}*G_\delta$ | $\frac{1}{8}*B_\alpha+\frac{1}{8}*B_\beta+\frac{2}{8}*B_\gamma+\frac{4}{8}*B_\delta$ |
| 1α + 1β + 1γ + 5δ | $\frac{1}{8}*R_\alpha+\frac{1}{8}*R_\beta+\frac{1}{8}*R_\gamma+\frac{5}{8}*R_\delta$ | $\frac{1}{8}*G_\alpha+\frac{1}{8}*G_\beta+\frac{1}{8}*G_\gamma+\frac{5}{8}*G_\delta$ | $\frac{1}{8}*B_\alpha+\frac{1}{8}*B_\beta+\frac{1}{8}*B_\gamma+\frac{5}{8}*B_\delta$ |

calculating RGB values ($R_\xi$, $G_\xi$, $B_\xi$) of the chenille carpet pile ξ corresponding to different combinations of 8 raw filaments α, β, γ, δ.

In a preferred technical solution of the present disclosure, step D may include: selecting combinations of four base colors with a hue difference of less than 60° from the preset base colors; dyeing, by the combinations of the four base colors, the raw filaments α, β, γ, δ in the multiple types of pile filaments respectively according to step B to obtain multiple types of mixed-color pile filaments with a hue difference of less than 60°; and constructing, based on the RGB values ($R_\xi$, $G_\xi$, $B_\xi$) of the chenille carpet pile ξ corresponding to different combinations of specified numbers of raw filaments α, β, γ, δ, a chenille carpet pile with a hazy color mixing effect by tufting the multiple types of mixed-color pile filaments with a hue difference of less than 60°.

In a preferred technical solution of the present disclosure, step D may include: selecting combinations of four base colors with a hue difference of greater than 60° and less than 120° from the preset base colors; dyeing, by the combinations of the four base colors, the raw filaments α, β, γ, δ in the multiple types of pile filaments respectively according to step B to obtain multiple types of mixed-color pile filaments with a hue difference of greater than 60° and less than 120°; and constructing, based on the RGB values ($R_\xi$, $G_\xi$, $B_\xi$) of the chenille carpet pile ξ corresponding to different combinations of specified numbers of raw filaments α, β, γ, δ, a chenille carpet pile with a moderate color mixing effect by tufting the multiple types of mixed-color pile filaments with a hue difference of greater than 60° and less than 120°.

In a preferred technical solution of the present disclosure, step D may include: selecting combinations of four base colors with a hue difference of greater than 120° and less than 180° from the preset base colors, and selecting combinations of three base colors with a hue difference of greater than 120° and less than 180° from the preset base colors to cooperate with white or black to form combinations of four base colors; dyeing, by the combinations of four base colors, the raw filaments α, β, γ, δ in the multiple types of pile filaments respectively according to step B to obtain multiple types of mixed-color pile filaments with a hue difference of greater than 120° and less than 180°; and constructing, based on the RGB values ($R_\xi$, $G_\xi$, $B_\xi$) of the chenille carpet pile ξ corresponding to different combinations of specified numbers of raw filaments α, β, γ, δ, a chenille carpet pile with a clear color mixing effect by tufting the multiple types of mixed-color pile filaments with a hue difference of greater than 120° and less than 180°.

Compared with the prior art, the above technical solutions of the present disclosure have the following technical effects:

The present disclosure combines raw filaments with different dyeing properties to prepare chenille yarns, and changes the combination modes and ratios of the raw filaments to prepare a four-component chenille carpet pile. The present disclosure realizes the heterochromaticity of the four-component pile through the uneven distribution of different dyes on the four-component raw filaments, and regulates the color difference of the four-component filaments after dyeing to form patterns with hazy, moderate and clear color mixing effects. Different from the additive mixing of color light and the subtractive mixing of pigments, the mixing of different colors dyed on the fibers in the four-component chenille carpet pile is spatial juxtaposition mixing, which forms a non-uniform and constant mixed color. According to the different mixing ratios of the color fibers and the interaction between the fiber hues, a composite color consisting of dominant and secondary hues are produced. The composite color will blend or separate with different viewing distance, angle, ambient light and other factors, resulting in a dynamic color. The entire design implementation of the present disclosure can effectively improve the efficiency of constructing the pattern of the chenille carpet pile.

BRIEF DESCRIPTION OF THE DRAWINGS

FIG. 3 shows the practical application of the pattern construction of the chenille carpet pile with a gradient change in the hazy color mixing effect.

FIG. 4 shows the practical application of the pattern construction of the chenille carpet pile with a gradient change in the moderate color mixing effect.

FIG. 5 shows the practical application of the pattern construction of the chenille carpet pile with a gradient change in the clear color mixing effect.

DETAILED DESCRIPTION OF THE EMBODIMENTS

The specific implementation of the present disclosure will be further described in detail below with reference to the drawings.

Figure 1:
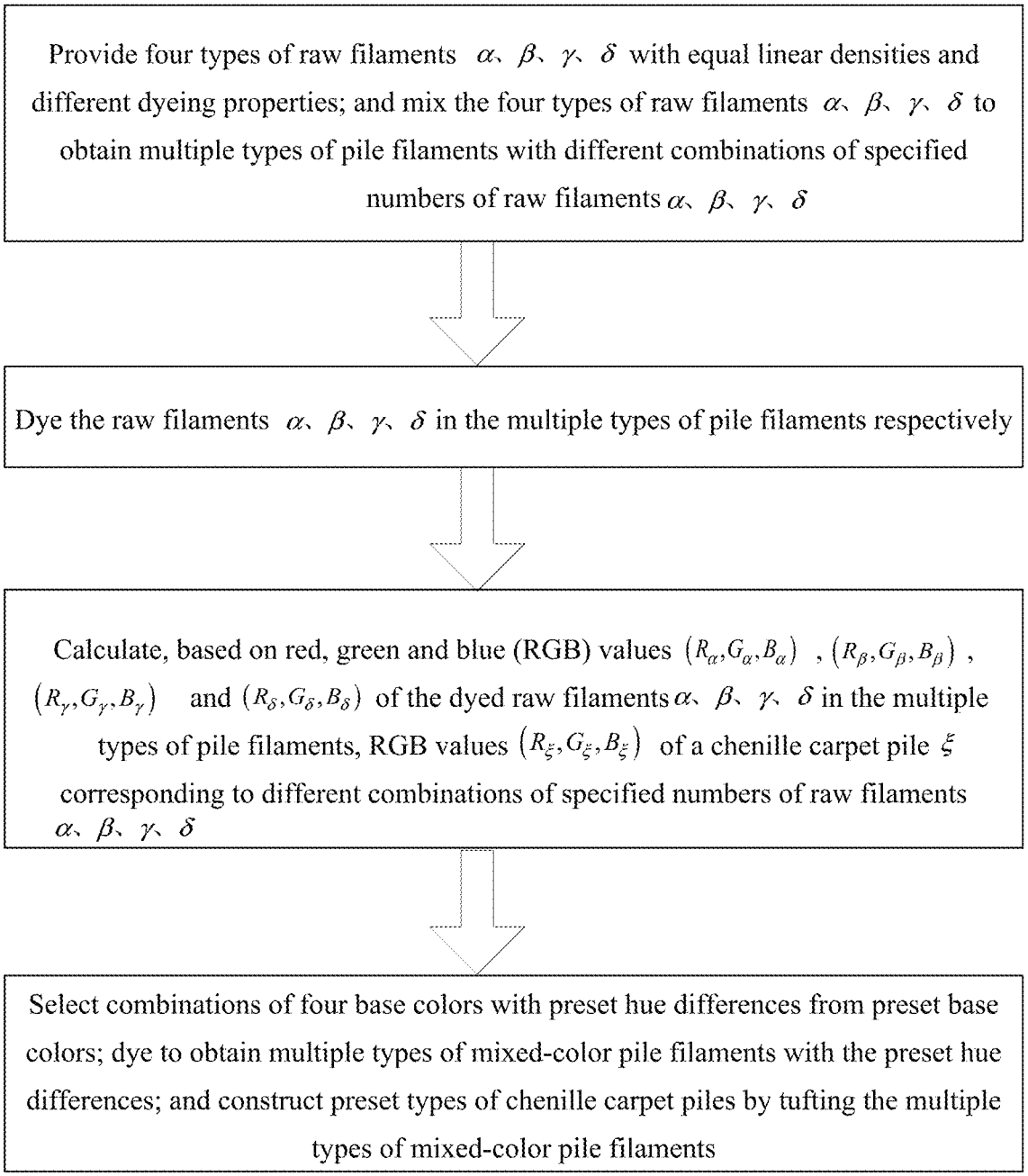
FIG. 1 is a regulation method of easy dyeing for patterning a four-component chenille carpet pile according to the present disclosure.

The present disclosure proposes a regulation method of easy dyeing for patterning a four-component chenille carpet pile. In a practical application, as shown in FIG. 1, the method specifically includes Steps A to D.

Step A: Provide four types of raw filaments α, β, γ, δ with equal linear densities and different dyeing properties, for example, polyester filaments, cationically dyeable polyester filaments, polyamide filaments, cationically modified viscose filaments, viscose filaments, acrylic filaments and cationically dyeable acrylic filaments, as shown in Table 1:

TABLE 1

| | Numbers of raw filaments | | | | | | | | | | | |
|---|---|---|---|---|---|---|---|---|---|---|---|---|
| | 4 filaments | | | | 6 filaments | | | | 8 filaments | | | |
| Combinations | α | β | γ | δ | α | β | γ | δ | α | β | γ | δ |
| 1 | 1/4 | 1/4 | 1/4 | 1/4 | 3/6 | 1/6 | 1/6 | 1/6 | 5/8 | 1/8 | 1/8 | 1/8 |
| 2 | | | | | 2/6 | 2/6 | 1/6 | 1/6 | 4/8 | 2/8 | 1/8 | 1/8 |
| 3 | | | | | 2/6 | 1/6 | 2/6 | 1/6 | 4/8 | 1/8 | 2/8 | 1/8 |
| 4 | | | | | 2/6 | 1/6 | 1/6 | 2/6 | 4/8 | 1/8 | 1/8 | 2/8 |
| 5 | | | | | 1/6 | 3/6 | 1/6 | 1/6 | 3/8 | 3/8 | 1/8 | 1/8 |
| 6 | | | | | 1/6 | 2/6 | 2/6 | 1/6 | 3/8 | 2/8 | 2/8 | 1/8 |
| 7 | | | | | 1/6 | 2/6 | 1/6 | 2/6 | 3/8 | 2/8 | 1/8 | 2/8 |
| 8 | | | | | 1/6 | 1/6 | 3/6 | 1/6 | 3/8 | 1/8 | 3/8 | 1/8 |
| 9 | | | | | 1/6 | 1/6 | 2/6 | 2/6 | 3/8 | 1/8 | 2/8 | 2/8 |
| 10 | | | | | 1/6 | 1/6 | 1/6 | 3/6 | 3/8 | 1/8 | 1/8 | 3/8 |
| 11 | | | | | | | | | 2/8 | 4/8 | 1/8 | 1/8 |
| 12 | | | | | | | | | 2/8 | 3/8 | 2/8 | 1/8 |
| 13 | | | | | | | | | 2/8 | 3/8 | 1/8 | 2/8 |
| 14 | | | | | | | | | 2/8 | 2/8 | 3/8 | 1/8 |
| 15 | | | | | | | | | 2/8 | 2/8 | 2/8 | 2/8 |
| 16 | | | | | | | | | 2/8 | 2/8 | 1/8 | 3/8 |
| 17 | | | | | | | | | 2/8 | 1/8 | 4/8 | 1/8 |
| 18 | | | | | | | | | 2/8 | 1/8 | 3/8 | 2/8 |
| 19 | | | | | | | | | 2/8 | 1/8 | 2/8 | 3/8 |
| 20 | | | | | | | | | 2/8 | 1/8 | 1/8 | 4/8 |
| 21 | | | | | | | | | 1/8 | 5/8 | 1/8 | 1/8 |
| 22 | | | | | | | | | 1/8 | 4/8 | 2/8 | 1/8 |
| 23 | | | | | | | | | 1/8 | 4/8 | 1/8 | 2/8 |
| 24 | | | | | | | | | 1/8 | 3/8 | 3/8 | 1/8 |
| 25 | | | | | | | | | 1/8 | 3/8 | 2/8 | 2/8 |
| 26 | | | | | | | | | 1/8 | 3/8 | 1/8 | 3/8 |
| 27 | | | | | | | | | 1/8 | 2/8 | 4/8 | 1/8 |
| 28 | | | | | | | | | 1/8 | 2/8 | 3/8 | 2/8 |
| 29 | | | | | | | | | 1/8 | 2/8 | 2/8 | 3/8 |
| 30 | | | | | | | | | 1/8 | 2/8 | 1/8 | 4/8 |
| 31 | | | | | | | | | 1/8 | 1/8 | 5/8 | 1/8 |
| 32 | | | | | | | | | 1/8 | 1/8 | 4/8 | 2/8 |
| 33 | | | | | | | | | 1/8 | 1/8 | 3/8 | 3/8 |
| 34 | | | | | | | | | 1/8 | 1/8 | 2/8 | 4/8 |
| 35 | | | | | | | | | 1/8 | 1/8 | 1/8 | 5/8 |

mix the four types of raw filaments α, β, γ, δ through gradient matching to obtain pile filaments with different combinations of specified numbers of raw filaments α, β, γ, δ, which form a four-component chenille carpet pile filament system; and proceed to Step B.

Figure 2:
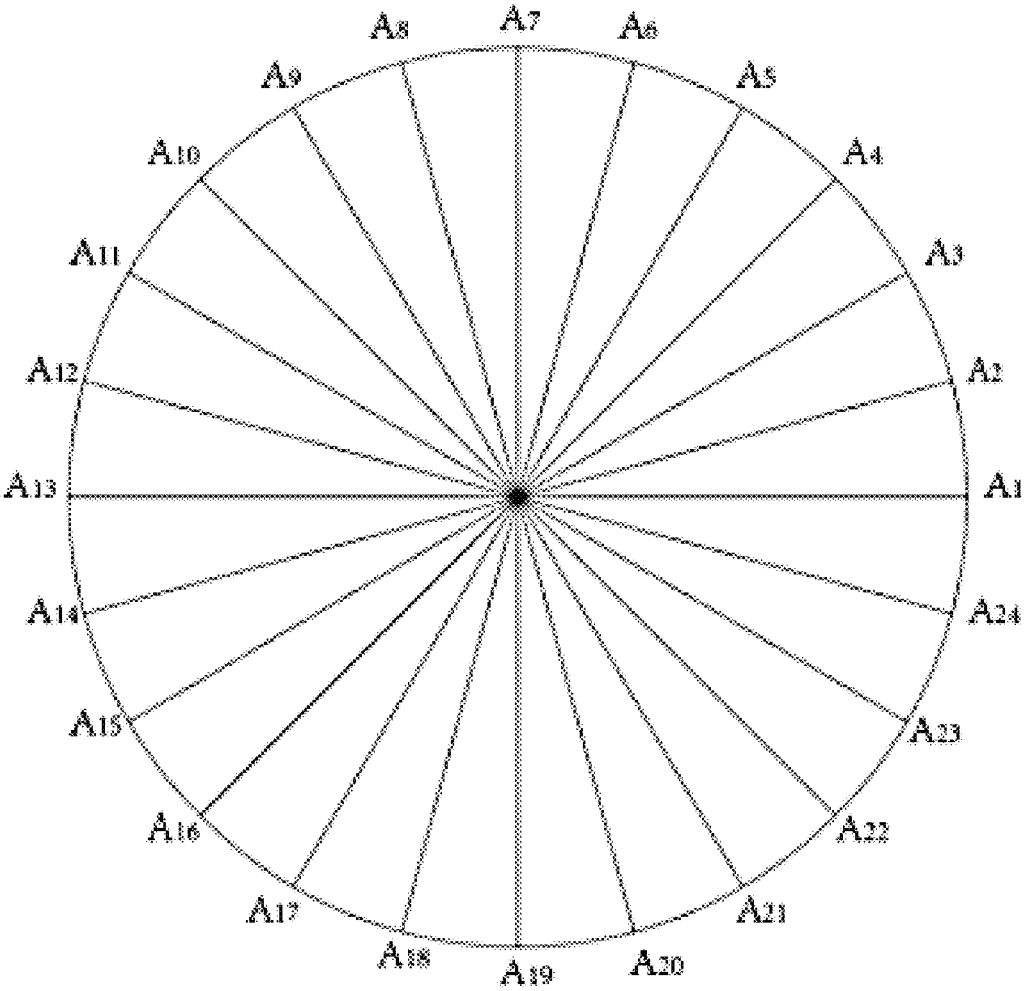
FIG. 2 is a schematic diagram of 24 base colors.

Step B. Select four base colors from 26 base colors including $A_1$, $A_2$, $A_3$, . . . , $A_{22}$, $A_{23}$, $A_{24}$, white (W) and black (K), where red, green and blue (RGB) values of $A_1$, $A_2$, $A_3$, . . . , $A_{22}$, $A_{23}$, $A_{24}$ (FIG. 2) are shown in Table 8:

TABLE 8

| A1 | A2 | A3 | A4 |
|---|---|---|---|
| (255, 0, 0) | (255, 64, 0) | (255, 128, 0) | (255, 191, 0) |

TABLE 8-continued

| | | | |
|---|---|---|---|
| A5 (255, 255, 0) | A6 (191, 255, 0) | A7 (128, 255, 0) | A8 (64, 255, 0) |
| A9 (0, 255, 0) | A10 (0, 255, 64) | A11 (0, 255, 128) | A12 (0, 255, 191) |
| A13 (0, 255, 255) | A14 (0, 191, 255) | A15 (0, 128, 255) | A16 (0, 64, 255) |
| A17 (0, 0, 255) | A18 (64, 0, 255) | A19 (128, 0, 255) | A20 (191, 0, 255) |
| A21 (255, 0, 255) | A22 (255, 0, 191) | A23 (255, 0, 128) | A24 (255, 0, 64) |

dye the pile filaments, by four types of dyes that are respectively applicable to the raw filaments α, β, γ, δ with different dyeing properties and have different base colors, the multiple types of pile filaments with different combinations of specified numbers of raw filaments α, β, γ, δ, that is, dye the raw filaments α, β, γ, δ in the multiple types of pile filaments respectively; and proceed to Step C. By selecting and combining four base colors from these base colors, $C_{26}^{4}=14950$ quaternary dyeing modes are achieved.

Step C: Calculate, based on RGB values ($R_\alpha$, $G_\alpha$, $B_\alpha$), ($R_\beta$, $G_\beta$, $B_\beta$), ($R_\gamma$, $G_\gamma$, $B_\gamma$) and ($R_\xi$, $G_\xi$, $B_\xi$) of the dyed raw filaments α, β, γ, δ in the multiple types of pile filaments with different combinations of specified numbers of raw filaments α, β, γ, δ, RGB values of the multiple types of pile filaments with different combinations of specified numbers of raw filaments α, β, γ, δ, that is, calculate RGB values ($R_\xi$, $G_\xi$, $B_\xi$) of a chenille carpet pile ξ corresponding to different combinations of specified numbers of raw filaments α, β, γ, δ; and proceed to step D.

In a specific practical application of Step C, for example, the RGB values ($R_\xi$, $G_\xi$, $B_\xi$) of the chenille carpet pile ξ corresponding to different combinations of 4, 6 and 8 raw filaments α, β, γ, δ are calculated, as shown in Table 2.

TABLE 2

| Combinations | RGB values after combination | | |
|---|---|---|---|
| | $R_\xi$ | $G_\xi$ | $B_\xi$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |

RGB values ($R_\xi$, $G_\xi$, $B_\xi$) of the chenille carpet pile ξ corresponding to different combinations of 4 raw filaments α, β, γ, δ are calculated.

A design of the chenille carpet pile ξ corresponding to 6 raw filaments is shown in Table 3.

TABLE 3

| Combinations | RGB values after combination | | |
|---|---|---|---|
| | $R_\xi$ | $G_\xi$ | $B_\xi$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 2α + 2β + 1γ + 1δ | $\frac{2}{6}*R_\alpha+\frac{2}{6}*R_\beta+\frac{1}{6}*R_\gamma+\frac{1}{6}*R_\delta$ | $\frac{2}{6}*G_\alpha+\frac{2}{6}*G_\beta+\frac{1}{6}*G_\gamma+\frac{1}{6}*G_\delta$ | $\frac{2}{6}*B_\alpha+\frac{2}{6}*B_\beta+\frac{1}{6}*B_\gamma+\frac{1}{6}*B_\delta$ |
| 2α + 1β + 2γ + 1δ | $\frac{2}{6}*R_\alpha+\frac{1}{6}*R_\beta+\frac{2}{6}*R_\gamma+\frac{1}{6}*R_\delta$ | $\frac{2}{6}*G_\alpha+\frac{1}{6}*G_\beta+\frac{2}{6}*G_\gamma+\frac{1}{6}*G_\delta$ | $\frac{2}{6}*B_\alpha+\frac{1}{6}*B_\beta+\frac{2}{6}*B_\gamma+\frac{1}{6}*B_\delta$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 1α + 2β + 2γ + 1δ | $\frac{1}{6}*R_\alpha+\frac{2}{6}*R_\beta+\frac{2}{6}*R_\gamma+\frac{1}{6}*$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 2β + 1γ + 2δ | $\frac{1}{6}*R_\alpha+\frac{2}{6}*R_\beta+\frac{1}{6}*R_\gamma+\frac{2}{6}*R_\delta$ | $\frac{1}{6}*G_\alpha+\frac{2}{6}*G_\beta+\frac{1}{6}*G_\gamma+\frac{2}{6}*G_\delta$ | $\frac{1}{6}*B_\alpha+\frac{2}{6}*B_\beta+\frac{1}{6}*B_\gamma+\frac{2}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1α + 1β + 2γ + 2δ | $\frac{1}{6}*R_\alpha+\frac{1}{6}*R_\beta+\frac{2}{6}*R_\gamma+\frac{2}{6}*R_\delta$ | $\frac{1}{6}*G_\alpha+\frac{1}{6}*G_\beta+\frac{2}{6}*G_\gamma+\frac{2}{6}*G_\delta$ | $\frac{1}{6}*B_\alpha+\frac{1}{6}*B_\beta+\frac{2}{6}*B_\gamma+\frac{2}{6}*B_\delta$ |
| 1α + 1β + 1γ + 3δ | $\frac{1}{6}*R_\alpha+\frac{1}{6}*R_\beta+\frac{1}{6}*R_\gamma+\frac{3}{6}*R_\delta$ | $\frac{1}{6}*G_\alpha+\frac{1}{6}*G_\beta+\frac{1}{6}*G_\gamma+\frac{3}{6}*G_\delta$ | $\frac{1}{6}*B_\alpha+\frac{1}{6}*B_\beta+\frac{1}{6}*B_\gamma+\frac{3}{6}*B_\delta$ |

RGB values ($R_\xi$, $G_\xi$, $B_\xi$) of the chenille carpet pile ξ corresponding to different combinations of 6 raw filaments α, β, γ, δ are calculated.

A design of the chenille carpet pile ξ corresponding to 8 raw filaments is shown in Table 4.

TABLE 4

| | RGB values after combination | | |
|---|---|---|---|
| Combinations | $R_\xi$ | $G_\xi$ | $B_\xi$ |
| 5α + 1β + 1γ + 1δ | $\frac{5}{8}*R_\alpha+\frac{1}{8}*R_\beta+\frac{1}{8}*R_\gamma+\frac{1}{8}*R_\delta$ | $\frac{5}{8}*G_\alpha+\frac{1}{8}*G_\beta+\frac{1}{8}*G_\gamma+\frac{1}{8}*G_\delta$ | $\frac{5}{8}*B_\alpha+\frac{1}{8}*B_\beta+\frac{1}{8}*B_\gamma+\frac{1}{8}*B_\delta$ |
| 4α + 2β + 1γ + 1δ | $\frac{4}{8}*R_\alpha+\frac{2}{8}*R_\beta+\frac{1}{8}*R_\gamma+\frac{1}{8}*R_\delta$ | $\frac{4}{8}*G_\alpha+\frac{2}{8}*G_\beta+\frac{1}{8}*G_\gamma+\frac{1}{8}*G_\delta$ | $\frac{4}{8}*B_\alpha+\frac{2}{8}*B_\beta+\frac{1}{8}*B_\gamma+\frac{1}{8}*B_\delta$ |
| 4α + 1β + 2γ + 1δ | $\frac{4}{8}*R_\alpha+\frac{1}{8}*R_\beta+\frac{2}{8}*R_\gamma+\frac{1}{8}*R_\delta$ | $\frac{4}{8}*G_\alpha+\frac{1}{8}*G_\beta+\frac{2}{8}*G_\gamma+\frac{1}{8}*G_\delta$ | $\frac{4}{8}*B_\alpha+\frac{1}{8}*B_\beta+\frac{2}{8}*B_\gamma+\frac{1}{8}*B_\delta$ |
| 4α + 1β + 1γ + 2δ | $\frac{4}{8}*R_\alpha+\frac{1}{8}*R_\beta+\frac{1}{8}*R_\gamma+\frac{2}{8}*R_\delta$ | $\frac{4}{8}*G_\alpha+\frac{1}{8}*G_\beta+\frac{1}{8}*G_\gamma+\frac{2}{8}*G_\delta$ | $\frac{4}{8}*B_\alpha+\frac{1}{8}*B_\beta+\frac{1}{8}*B_\gamma+\frac{2}{8}*B_\delta$ |
| 3α + 3β + 1γ + 1δ | $\frac{3}{8}*R_\alpha+\frac{3}{8}*R_\beta+\frac{1}{8}*R_\gamma+\frac{1}{8}*R_\delta$ | $\frac{3}{8}*G_\alpha+\frac{3}{8}*G_\beta+\frac{1}{8}*G_\gamma+\frac{1}{8}*G_\delta$ | $\frac{3}{8}*B_\alpha+\frac{3}{8}*B_\beta+\frac{1}{8}*B_\gamma+\frac{1}{8}*B_\delta$ |
| 3α + 2β + 2γ + 1δ | $\frac{3}{8}*R_\alpha+\frac{2}{8}*R_\beta+\frac{2}{8}*R_\gamma+\frac{1}{8}*R_\delta$ | $\frac{3}{8}*G_\alpha+\frac{2}{8}*G_\beta+\frac{2}{8}*G_\gamma+\frac{1}{8}*G_\delta$ | $\frac{3}{8}*B_\alpha+\frac{2}{8}*B_\beta+\frac{2}{8}*B_\gamma+\frac{1}{8}*B_\delta$ |
| 3α + 2β + 1γ + 2δ | $\frac{3}{8}*R_\alpha+\frac{2}{8}*R_\beta+\frac{1}{8}*R_\gamma+\frac{2}{8}*R_\delta$ | $\frac{3}{8}*G_\alpha+\frac{2}{8}*G_\beta+\frac{1}{8}*G_\gamma+\frac{2}{8}*G_\delta$ | $\frac{3}{8}*B_\alpha+\frac{2}{8}*B_\beta+\frac{1}{8}*B_\gamma+\frac{2}{8}*B_\delta$ |
| 3α + 1β + 3γ + 1δ | $\frac{3}{8}*R_\alpha+\frac{1}{8}*R_\beta+\frac{3}{8}*R_\gamma+\frac{1}{8}*R_\delta$ | $\frac{3}{8}*G_\alpha+\frac{1}{8}*G_\beta+\frac{3}{8}*G_\gamma+\frac{1}{8}*G_\delta$ | $\frac{3}{8}*B_\alpha+\frac{1}{8}*B_\beta+\frac{3}{8}*B_\gamma+\frac{1}{8}*B_\delta$ |
| 3α + 1β + 2γ + 2δ | $\frac{3}{8}*R_\alpha+\frac{1}{8}*R_\beta+\frac{2}{8}*R_\gamma+\frac{2}{8}*R_\delta$ | $\frac{3}{8}*G_\alpha+\frac{1}{8}*G_\beta+\frac{2}{8}*G_\gamma+\frac{2}{8}*G_\delta$ | $\frac{3}{8}*B_\alpha+\frac{1}{8}*B_\beta+\frac{2}{8}*B_\gamma+\frac{2}{8}*B_\delta$ |
| 3α + 1β + 1γ + 3δ | $\frac{3}{8}*R_\alpha+\frac{1}{8}*R_\beta+\frac{1}{8}*R_\gamma+\frac{3}{8}*R_\delta$ | $\frac{3}{8}*G_\alpha+\frac{1}{8}*G_\beta+\frac{1}{8}*G_\gamma+\frac{3}{8}*G_\delta$ | $\frac{3}{8}*B_\alpha+\frac{1}{8}*B_\beta+\frac{1}{8}*B_\gamma+\frac{3}{8}*B_\delta$ |
| 2α + 4β + 1γ + 1δ | $\frac{2}{8}*R_\alpha+\frac{4}{8}*R_\beta+\frac{1}{8}*R_\gamma+\frac{1}{8}*R_\delta$ | $\frac{2}{8}*G_\alpha+\frac{4}{8}*G_\beta+\frac{1}{8}*G_\gamma+\frac{1}{8}*G_\delta$ | $\frac{2}{8}*B_\alpha+\frac{4}{8}*B_\beta+\frac{1}{8}*B_\gamma+\frac{1}{8}*B_\delta$ |
| 2α + 3β + 2γ + 1δ | $\frac{2}{8}*R_\alpha+\frac{3}{8}*R_\beta+\frac{2}{8}*R_\gamma+\frac{1}{8}*R_\delta$ | $\frac{2}{8}*G_\alpha+\frac{3}{8}*G_\beta+\frac{2}{8}*G_\gamma+\frac{1}{8}*G_\delta$ | $\frac{2}{8}*B_\alpha+\frac{3}{8}*B_\beta+\frac{2}{8}*B_\gamma+\frac{1}{8}*B_\delta$ |
| 2α + 3β + 1γ + 2δ | $\frac{2}{8}*R_\alpha+\frac{3}{8}*R_\beta+\frac{1}{8}*R_\gamma+\frac{2}{8}*R_\delta$ | $\frac{2}{8}*G_\alpha+\frac{3}{8}*G_\beta+\frac{1}{8}*G_\gamma+\frac{2}{8}*G_\delta$ | $\frac{2}{8}*B_\alpha+\frac{3}{8}*B_\beta+\frac{1}{8}*B_\gamma+\frac{2}{8}*B_\delta$ |
| 2α + 2β + 3γ + 1δ | $\frac{2}{8}*R_\alpha+\frac{2}{8}*R_\beta+\frac{3}{8}*R_\gamma+\frac{1}{8}*R_\delta$ | $\frac{2}{8}*G_\alpha+\frac{2}{8}*G_\beta+\frac{3}{8}*G_\gamma+\frac{1}{8}*G_\delta$ | $\frac{2}{8}*B_\alpha+\frac{2}{8}*B_\beta+\frac{3}{8}*B_\gamma+\frac{1}{8}*B_\delta$ |
| 2α + 2β + 2γ + 2δ | $\frac{2}{8}*R_\alpha+\frac{2}{8}*R_\beta+\frac{2}{8}*R_\gamma+\frac{2}{8}*R_\delta$ | $\frac{2}{8}*G_\alpha+\frac{2}{8}*G_\beta+\frac{2}{8}*G_\gamma+\frac{2}{8}*G_\delta$ | $\frac{2}{8}*B_\alpha+\frac{2}{8}*B_\beta+\frac{2}{8}*B_\gamma+\frac{2}{8}*B_\delta$ |
| 2α + 2β + 1γ + 3δ | $\frac{2}{8}*R_\alpha+\frac{2}{8}*R_\beta+\frac{1}{8}*R_\gamma+\frac{3}{8}*R_\delta$ | $\frac{2}{8}*G_\alpha+\frac{2}{8}*G_\beta+\frac{1}{8}*G_\gamma+\frac{3}{8}*G_\delta$ | $\frac{2}{8}*B_\alpha+\frac{2}{8}*B_\beta+\frac{1}{8}*B_\gamma+\frac{3}{8}*B_\delta$ |
| 2α + 1β + 4γ + 1δ | $\frac{2}{8}*R_\alpha+\frac{1}{8}*R_\beta+\frac{4}{8}*R_\gamma+\frac{1}{8}*R_\delta$ | $\frac{2}{8}*G_\alpha+\frac{1}{8}*G_\beta+\frac{4}{8}*G_\gamma+\frac{1}{8}*G_\delta$ | $\frac{2}{8}*B_\alpha+\frac{1}{8}*B_\beta+\frac{4}{8}*B_\gamma+\frac{1}{8}*B_\delta$ |
| 2α + 1β + 3γ + 2δ | $\frac{2}{8}*R_\alpha+\frac{1}{8}*R_\beta+\frac{3}{8}*R_\gamma+\frac{2}{8}*R_\delta$ | $\frac{2}{8}*G_\alpha+\frac{1}{8}*G_\beta+\frac{3}{8}*G_\gamma+\frac{2}{8}*G_\delta$ | $\frac{2}{8}*B_\alpha+\frac{1}{8}*B_\beta+\frac{3}{8}*B_\gamma+\frac{2}{8}*B_\delta$ |
| 2α + 1β + 2γ + 3δ | $\frac{2}{8}*R_\alpha+\frac{1}{8}*R_\beta+\frac{2}{8}*R_\gamma+\frac{3}{8}*R_\delta$ | $\frac{2}{8}*G_\alpha+\frac{1}{8}*G_\beta+\frac{2}{8}*G_\gamma+\frac{3}{8}*G_\delta$ | $\frac{2}{8}*B_\alpha+\frac{1}{8}*B_\beta+\frac{2}{8}*B_\gamma+\frac{3}{8}*B_\delta$ |
| 2α + 1β + 1γ + 4δ | $\frac{2}{8}*R_\alpha+\frac{1}{8}*R_\beta+\frac{1}{8}*R_\gamma+\frac{4}{8}*R_\delta$ | $\frac{2}{8}*G_\alpha+\frac{1}{8}*G_\beta+\frac{1}{8}*G_\gamma+\frac{4}{8}*G_\delta$ | $\frac{2}{8}*B_\alpha+\frac{1}{8}*B_\beta+\frac{1}{8}*B_\gamma+\frac{4}{8}*B_\delta$ |
| 1α + 5β + 1γ + 1δ | $\frac{1}{8}*R_\alpha+\frac{5}{8}*R_\beta+\frac{1}{8}*R_\gamma+\frac{1}{8}*R_\delta$ | $\frac{1}{8}*G_\alpha+\frac{5}{8}*G_\beta+\frac{1}{8}*G_Y+\frac{1}{8}*G_\delta$ | $\frac{1}{8}*B_\alpha+\frac{5}{8}*B_\beta+\frac{1}{8}*B_\gamma+\frac{1}{8}*B_\delta$ |

TABLE 4-continued

| Combinations | RGB values after combination | | |
|---|---|---|---|
| | $R_\xi$ | $G_\xi$ | $B_\xi$ |
| $1\alpha + 4\beta + 2\gamma + 1\delta$ | $\frac{1}{8}*R_\alpha + \frac{4}{8}*R_\beta + \frac{2}{8}*R_\gamma + \frac{1}{8}*R_\delta$ | $\frac{1}{8}*G_\alpha + \frac{4}{8}*G_\beta + \frac{2}{8}*G_\gamma + \frac{1}{8}*G_\delta$ | $\frac{1}{8}*B_\alpha + \frac{4}{8}*B_\beta + \frac{2}{8}*B_\gamma + \frac{1}{8}*B_\delta$ |
| $1\alpha + 4\beta + 1\gamma + 2\delta$ | $\frac{1}{8}*R_\alpha + \frac{4}{8}*R_\beta + \frac{1}{8}*R_\gamma + \frac{2}{8}*R_\delta$ | $\frac{1}{8}*G_\alpha + \frac{4}{8}*G_\beta + \frac{1}{8}*G_\gamma + \frac{2}{8}*G_\delta$ | $\frac{1}{8}*B_\alpha + \frac{4}{8}*B_\beta + \frac{1}{8}*B_\gamma + \frac{2}{8}*B_\delta$ |
| $1\alpha + 3\beta + 3\gamma + 1\delta$ | $\frac{1}{8}*R_\alpha + \frac{3}{8}*R_\beta + \frac{3}{8}*R_\gamma + \frac{1}{8}*R_\delta$ | $\frac{1}{8}*G_\alpha + \frac{3}{8}*G_\beta + \frac{3}{8}*G_\gamma + \frac{1}{8}*G_\delta$ | $\frac{1}{8}*B_\alpha + \frac{3}{8}*B_\beta + \frac{3}{8}*B_\gamma + \frac{1}{8}*B_\delta$ |
| $1\alpha + 3\beta + 2\gamma + 2\delta$ | $\frac{1}{8}*R_\alpha + \frac{3}{8}*R_\beta + \frac{2}{8}*R_\gamma + \frac{2}{8}*R_\delta$ | $\frac{1}{8}*G_\alpha + \frac{3}{8}*G_\beta + \frac{2}{8}*G_\gamma + \frac{2}{8}*G_\delta$ | $\frac{1}{8}*B_\alpha + \frac{3}{8}*B_\beta + \frac{2}{8}*B_\gamma + \frac{2}{8}*B_\delta$ |
| $1\alpha + 3\beta + 1\gamma + 3\delta$ | $\frac{1}{8}*R_\alpha + \frac{3}{8}*R_\beta + \frac{1}{8}*R_\gamma + \frac{3}{8}*R_\delta$ | $\frac{1}{8}*G_\alpha + \frac{3}{8}*G_\beta + \frac{1}{8}*G_\gamma + \frac{3}{8}*G_\delta$ | $\frac{1}{8}*B_\alpha + \frac{3}{8}*B_\beta + \frac{1}{8}*B_\gamma + \frac{3}{8}*B_\delta$ |
| $1\alpha + 2\beta + 4\gamma + 1\delta$ | $\frac{1}{8}*R_\alpha + \frac{2}{8}*R_\beta + \frac{4}{8}*R_\gamma + \frac{1}{8}*R_\delta$ | $\frac{1}{8}*G_\alpha + \frac{2}{8}*G_\beta + \frac{4}{8}*G_\gamma + \frac{1}{8}*G_\delta$ | $\frac{1}{8}*B_\alpha + \frac{2}{8}*B_\beta + \frac{4}{8}*B_\gamma + \frac{1}{8}*B_\delta$ |
| $1\alpha + 2\beta + 3\gamma + 2\delta$ | $\frac{1}{8}*R_\alpha + \frac{2}{8}*R_\beta + \frac{3}{8}*R_\gamma + \frac{2}{8}*R_\delta$ | $\frac{1}{8}*G_\alpha + \frac{2}{8}*G_\beta + \frac{3}{8}*G_\gamma + \frac{2}{8}*G_\delta$ | $\frac{1}{8}*B_\alpha + \frac{2}{8}*B_\beta + \frac{3}{8}*B_\gamma + \frac{2}{8}*B_\delta$ |
| $1\alpha + 2\beta + 2\gamma + 3\delta$ | $\frac{1}{8}*R_\alpha + \frac{2}{8}*R_\beta + \frac{2}{8}*R_\gamma + \frac{3}{8}*R_\delta$ | $\frac{1}{8}*G_\alpha + \frac{2}{8}*G_\beta + \frac{2}{8}*G_\gamma + \frac{3}{8}*G_\delta$ | $\frac{1}{8}*B_\alpha + \frac{2}{8}*B_\beta + \frac{2}{8}*B_\gamma + \frac{3}{8}*B_\delta$ |
| $1\alpha + 2\beta + 1\gamma + 4\delta$ | $\frac{1}{8}*R_\alpha + \frac{2}{8}*R_\beta + \frac{1}{8}*R_\gamma + \frac{4}{8}*R_\delta$ | $\frac{1}{8}*G_\alpha + \frac{2}{8}*G_\beta + \frac{1}{8}*G_\gamma + \frac{4}{8}*G_\delta$ | $\frac{1}{8}*B_\alpha + \frac{2}{8}*B_\beta + \frac{1}{8}*B_\gamma + \frac{4}{8}*B_\delta$ |
| $1\alpha + 1\beta + 5\gamma + 1\delta$ | $\frac{1}{8}*R_\alpha + \frac{1}{8}*R_\beta + \frac{5}{8}*R_\gamma + \frac{1}{8}*R_\delta$ | $\frac{1}{8}*G_\alpha + \frac{1}{8}*G_\beta + \frac{5}{8}*G_\gamma + \frac{1}{8}*G_\delta$ | $\frac{1}{8}*B_\alpha + \frac{1}{8}*B_\beta + \frac{5}{8}*B_\gamma + \frac{1}{8}*B_\delta$ |
| $1\alpha + 1\beta + 4\gamma + 2\delta$ | $\frac{1}{8}*R_\alpha + \frac{1}{8}*R_\beta + \frac{4}{8}*R_\gamma + \frac{2}{8}*R_\delta$ | $\frac{1}{8}*G_\alpha + \frac{1}{8}*G_\beta + \frac{4}{8}*G_\gamma + \frac{2}{8}*G_\delta$ | $\frac{1}{8}*B_\alpha + \frac{1}{8}*B_\beta + \frac{4}{8}*B_\gamma + \frac{2}{8}*B_\delta$ |
| $1\alpha + 1\beta + 3\gamma + 3\delta$ | $\frac{1}{8}*R_\alpha + \frac{1}{8}*R_\beta + \frac{3}{8}*R_\gamma + \frac{3}{8}*R_\delta$ | $\frac{1}{8}*G_\alpha + \frac{1}{8}*G_\beta + \frac{3}{8}*G_\gamma + \frac{3}{8}*G_\delta$ | $\frac{1}{8}*B_\alpha + \frac{1}{8}*B_\beta + \frac{3}{8}*B_\gamma + \frac{3}{8}*B_\delta$ |
| $1\alpha + 1\beta + 2\gamma + 4\delta$ | $\frac{1}{8}*R_\alpha + \frac{1}{8}*R_\beta + \frac{2}{8}*R_\gamma + \frac{4}{8}*R_\delta$ | $\frac{1}{8}*G_\alpha + \frac{1}{8}*G_\beta + \frac{2}{8}*G_\gamma + \frac{4}{8}*G_\delta$ | $\frac{1}{8}*B_\alpha + \frac{1}{8}*B_\beta + \frac{2}{8}*B_\gamma + \frac{4}{8}*B_\delta$ |
| $1\alpha + 1\beta + 1\gamma + 5\delta$ | $\frac{1}{8}*R_\alpha + \frac{1}{8}*R_\beta + \frac{1}{8}*R_\gamma + \frac{5}{8}*R_\delta$ | $\frac{1}{8}*G_\alpha + \frac{1}{8}*G_\beta + \frac{1}{8}*G_\gamma + \frac{5}{8}*G_\delta$ | $\frac{1}{8}*B_\alpha + \frac{1}{8}*B_\beta + \frac{1}{8}*B_\gamma + \frac{5}{8}*B_\delta$ |

RGB values ($R_\xi$, $G_\xi$, $B_\xi$) of the chenille carpet pile $\xi$ corresponding to different combinations of 8 raw filaments $\alpha$, $\beta$, $\gamma$, $\delta$ are calculated.

For a unified dyeing scheme, the present disclosure regulates the mixing ratio of the four-component filaments such that the chenille pile can visually present a hazy, moderate or clear color mixing effect. For a four-component chenille pile with a certain mixing ratio, the present disclosure regulates the dominant and secondary hues of the dyed color of each component fiber by changing the dyeing formula, and regulates the color difference to make the chenille pile visually present a hazy, moderate or clear color mixing effect.

By dyeing the four-component fibers with the same color with different luminance and different saturation, or dyeing the four-component fibers with different colors in adjacent and analogous color areas, the mixed colors visually present a hazy color separation effect. By dyeing the four-component fibers with different colors in tetradic color areas, the mixed colors visually present a moderate color separation effect. By dyeing the four-component fibers with different colors in opponent color areas, the mixed colors visually present a clear color separation effect.

Step D: Select combinations of four base colors with preset hue differences from preset base colors; dyeing, by the combinations of the four base colors, the raw filaments $\alpha$, $\beta$, $\gamma$, $\delta$ in the multiple types of pile filaments respectively according to Step B to obtain multiple types of mixed-color pile filaments with the preset hue differences; and construct, based on the RGB values ($R_\xi$, $G_\xi$, $B_\xi$) of the chenille carpet pile $\xi$ corresponding to different combinations of specified numbers of raw filaments $\alpha$, $\beta$, $\gamma$, $\delta$ preset types of chenille carpet piles by tufting the multiple types of mixed-color pile filaments with the preset hue differences.

Specifically, in Step D, the preset hue differences include a hue difference of less than 60°, a hue difference of greater than 60° and less than 120°, and a hue difference of greater than 120° and less than 180°. In a specific design implementation, when the hue difference is less than 60°, combinations of four base colors with a hue difference of less than 60° are selected from the preset base colors. The raw filaments $\alpha$, $\beta$, $\gamma$, $\delta$ in the multiple types of pile filaments are dyed respectively by the combinations of the four base colors according to Step B to obtain multiple types of mixed-color pile filaments with a hue difference of less than 60°. Based on the RGB values ($R_\xi$, $G_\xi$, $B_\xi$) of the chenille carpet pile $\xi$ corresponding to different combinations of specified numbers of raw filaments α, β, γ, δ, a chenille carpet pile with a moderate color mixing effect is constructed by tufting the multiple types of mixed-color pile filaments with a hue difference of less than 60°.

In the method of tufting mixed-color pile filaments, when the chenille carpet pile is prepared by mixing 4 raw filaments, a color mixing gradient is ¼. When the chenille carpet pile is prepared by mixing 6 raw filaments, the color mixing gradient is ⅙. When the chenille carpet pile is prepared by mixing 8 raw filaments, the color mixing gradient is ⅛.

When the hue difference is greater than 60° and less than 120°, combinations of four base colors with a hue difference of greater than 60° and less than 120° are selected from the preset base colors. The raw filaments α, β, γ, δ in the multiple types of pile filaments are dyed respectively by the combinations of the four base colors according to Step B to obtain multiple types of mixed-color pile filaments with a hue difference of greater than 60° and less than 120°. Based on the RGB values ($R_\xi$, $G_\xi$, $B_\xi$) of the chenille carpet pile ξ corresponding to different combinations of specified numbers of raw filaments α, β, γ, δ, a chenille carpet pile with a moderate color mixing effect is constructed by tufting the multiple types of mixed-color pile filaments with a hue difference of greater than 60° and less than 120°.

In the method of tufting mixed-color pile filaments, when the chenille carpet pile is prepared by mixing 4 raw filaments, the color mixing gradient is ¼. When the chenille carpet pile is prepared by mixing 6 raw filaments, the color mixing gradient is ⅙. When the chenille carpet pile is prepared by mixing 8 raw filaments, the color mixing gradient is ⅛.

When the hue difference is greater than 120° and less than 180°, combinations of four base colors with a hue difference of greater than 120° and less than 180° and combinations of three base colors with a hue difference of greater than 120° and less than 180° are selected from the preset base colors from the preset base colors to cooperate with white or black to form combinations of four base colors. The raw filaments α, β, γ, δ in the multiple types of pile filaments are dyed respectively by the combinations of four base colors according to Step B to obtain multiple types of mixed-color pile filaments with a hue difference of greater than 120° and less than 180°. Based on the RGB values ($R_\xi$, $G_\xi$, $B_\xi$) of the chenille carpet pile ξ corresponding to different combinations of specified numbers of raw filaments α, β, γ, δ, a chenille carpet pile with a clear color mixing effect is constructed by tufting the multiple types of mixed-color pile filaments with a hue difference of greater than 120° and less than 180°.

In the method of tufting mixed-color pile filaments, when the chenille carpet pile is prepared by mixing 4 raw filaments, a color mixing gradient is ¼. When the chenille carpet pile is prepared by mixing 6 raw filaments, the color mixing gradient is ⅙. When the chenille carpet pile is prepared by mixing 8 raw filaments, the color mixing gradient is ⅛.

FIG. 3 shows the practical application of the construction of the pattern of the chenille carpet pile, the application of the RGB values ($R_\xi$, $G_\xi$, $B_\xi$) of the chenille carpet pile ξ corresponding to 6 raw filaments, the application of the 24 base colors, and the design of gradient patterns of color-mixed chenille carpet piles in an embodiment regarding chenille carpet piles with a gradient change in the hazy color mixing effect.

The RGB values of the chenille carpet pile with a hazy color mixing effect are shown in Table 5.

TABLE 5

| SN | Combinations of colors | Color mixing ratio | | RGB values ξ($R_\xi$, $G_\xi$, $B_\xi$) of gradient mixed-color pile filaments | | |
|---|---|---|---|---|---|---|
| 1 | $A_1 + A_2 + A_3 + A_5$ | Column A pile | $3/6*C_{A1} + 1/6*C_{A2} + 1/6*C_{A3} + 1/6*C_{A5}$ | 255 | 74 | 0 |
| | | Column B pile | $2/6*C_{A1} + 2/6*C_{A2} + 1/6*C_{A3} + 1/6*C_{A5}$ | 255 | 85 | 0 |
| | | Column C pile | $1/6*C_{A1} + 3/6*C_{A2} + 1/6*C_{A3} + 1/6*C_{A5}$ | 255 | 96 | 0 |
| | | Column D pile | $1/6*C_{A1} + 2/6*C_{A2} + 2/6*C_{A3} + 1/6*C_{A5}$ | 255 | 106 | 0 |
| | | Column E pile | $1/6*C_{A1} + 1/6*C_{A2} + 3/6*C_{A3} + 1/6*C_{A5}$ | 255 | 117 | 0 |
| | | Column F pile | $1/6*C_{A1} + 1/6*C_{A2} + 2/6*C_{A3} + 2/6*C_{A5}$ | 255 | 138 | 0 |
| | | Column G pile | $1/6*C_{A1} + 1/6*C_{A2} + 1/6*C_{A3} + 3/6*C_{A5}$ | 255 | 159 | 0 |
| | | Column H pile | $2/6*C_{A1} + 1/6*C_{A2} + 1/6*C_{A3} + 2/6*C_{A5}$ | 255 | 117 | 0 |
| 2 | $A_2 + A_3 + A_4 + A_6$ | Column A pile | $3/6*C_{A2} + 1/6*C_{A3} + 1/6*C_{A4} + 1/6*C_{A6}$ | 244 | 128 | 0 |
| | | Column B pile | $2/6*C_{A2} + 2/6*C_{A3} + 1/6*C_{A4} + 1/6*C_{A6}$ | 244 | 138 | 0 |
| | | Column C pile | $1/6*C_{A2} + 3/6*C_{A3} + 1/6*C_{A4} + 1/6*C_{A6}$ | 244 | 149 | 0 |
| | | Column D pile | $1/6*C_{A2} + 2/6*C_{A3} + 2/6*C_{A4} + 1/6*C_{A6}$ | 244 | 160 | 0 |
| | | Column E pile | $1/6*C_{A2} + 1/6*C_{A3} + 3/6*C_{A4} + 1/6*C_{A6}$ | 244 | 170 | 0 |
| | | Column F pile | $1/6*C_{A2} + 1/6*C_{A3} + 2/6*C_{A4} + 2/6*C_{A6}$ | 233 | 181 | 0 |
| | | Column G pile | $1/6*C_{A2} + 1/6*C_{A3} + 1/6*C_{A4} + 3/6*C_{A6}$ | 223 | 191 | 0 |
| | | Column H pile | $2/6*C_{A2} + 1/6*C_{A3} + 1/6*C_{A4} + 2/6*C_{A6}$ | 233 | 160 | 0 |
| 3 | $A_3 + A_4 + A_5 + A_7$ | Column A pile | $3/6*C_{A3} + 1/6*C_{A4} + 1/6*C_{A5} + 1/6*C_{A7}$ | 233 | 181 | 0 |
| | | Column B pile | $2/6*C_{A3} + 2/6*C_{A4} + 1/6*C_{A5} + 1/6*C_{A7}$ | 233 | 191 | 0 |
| | | Column C pile | $1/6*C_{A3} + 3/6*C_{A4} + 1/6*C_{A5} + 1/6*C_{A7}$ | 233 | 202 | 0 |
| | | Column D pile | $1/6*C_{A3} + 2/6*C_{A4} + 2/6*C_{A5} + 1/6*C_{A7}$ | 233 | 213 | 0 |
| | | Column E pile | $1/6*C_{A3} + 1/6*C_{A4} + 3/6*C_{A5} + 1/6*C_{A7}$ | 233 | 223 | 0 |
| | | Column F pile | $1/6*C_{A3} + 1/6*C_{A4} + 2/6*C_{A5} + 2/6*C_{A7}$ | 213 | 223 | 0 |
| | | Column G pile | $1/6*C_{A3} + 1/6*C_{A4} + 1/6*C_{A5} + 3/6*C_{A7}$ | 191 | 223 | 0 |
| | | Column H pile | $2/6*C_{A3} + 1/6*C_{A4} + 1/6*C_{A5} + 2/6*C_{A7}$ | 213 | 202 | 0 |

FIG. 4 shows the application of the RGB values ($R_\xi$, $G_\xi$, $B_\xi$) of the chenille carpet pile ξ corresponding to 6 raw filaments, the application of the 24 base colors, and the design of gradient patterns of color-mixed chenille carpet piles in an embodiment regarding chenille carpet piles with a gradient change in the moderate color mixing effect.

The RGB values of the chenille carpet pile with a moderate color mixing effect are shown in Table 6.

TABLE 6

| SN | Combinations of colors | Color mixing ratio | | RGB values $\xi(R_\xi, G_\xi, B_\xi)$ of gradient mixed-color pile filaments | | |
|---|---|---|---|---|---|---|
| 1 | $A_1 + A_2 + A_3 + A_8$ | Column A pile | $3/6*C_{A1} + 1/6*C_{A2} + 1/6*C_{A3} + 1/6*C_{A8}$ | 223 | 75 | 0 |
| | | Column B pile | $2/6*C_{A1} + 2/6*C_{A2} + 1/6*C_{A3} + 1/6*C_{A8}$ | 223 | 80 | 0 |
| | | Column C pile | $1/6*C_{A1} + 3/6*C_{A2} + 1/6*C_{A3} + 1/6*C_{A8}$ | 223 | 96 | 0 |
| | | Column D pile | $1/6*C_{A1} + 2/6*C_{A2} + 2/6*C_{A3} + 1/6*C_{A8}$ | 223 | 107 | 0 |
| | | Column E pile | $1/6*C_{A1} + 1/6*C_{A2} + 3/6*C_{A3} + 1/6*C_{A8}$ | 223 | 117 | 0 |
| | | Column F pile | $1/6*C_{A1} + 1/6*C_{A2} + 2/6*C_{A3} + 2/6*C_{A8}$ | 191 | 138 | 0 |
| | | Column G pile | $1/6*C_{A1} + 1/6*C_{A2} + 1/6*C_{A3} + 3/6*C_{A8}$ | 159 | 160 | 0 |
| | | Column H pile | $2/6*C_{A1} + 1/6*C_{A2} + 1/6*C_{A3} + 2/6*C_{A8}$ | 191 | 117 | 0 |
| 2 | $A_2 + A_3 + A_4 + A_9$ | Column A pile | $3/6*C_{A2} + 1/6*C_{A3} + 1/6*C_{A4} + 1/6*C_{A9}$ | 213 | 128 | 0 |
| | | Column B pile | $2/6*C_{A2} + 2/6*C_{A3} + 1/6*C_{A4} + 1/6*C_{A9}$ | 213 | 138 | 0 |
| | | Column C pile | $1/6*C_{A2} + 3/6*C_{A3} + 1/6*C_{A4} + 1/6*C_{A9}$ | 213 | 149 | 0 |
| | | Column D pile | $1/6*C_{A2} + 2/6*C_{A3} + 2/6*C_{A4} + 1/6*C_{A9}$ | 213 | 160 | 0 |
| | | Column E pile | $1/6*C_{A2} + 1/6*C_{A3} + 3/6*C_{A4} + 1/6*C_{A9}$ | 213 | 170 | 0 |
| | | Column F pile | $1/6*C_{A2} + 1/6*C_{A3} + 2/6*C_{A4} + 2/6*C_{A9}$ | 170 | 181 | 0 |
| | | Column G pile | $1/6*C_{A2} + 1/6*C_{A3} + 1/6*C_{A4} + 3/6*C_{A9}$ | 128 | 191 | 0 |
| | | Column H pile | $2/6*C_{A2} + 1/6*C_{A3} + 1/6*C_{A4} + 2/6*C_{A9}$ | 170 | 160 | 0 |
| 3 | $A_3 + A_4 + A_5 + A_{10}$ | Column A pile | $3/6*C_{A3} + 1/6*C_{A4} + 1/6*C_{A5} + 1/6*C_{A10}$ | 213 | 181 | 11 |
| | | Column B pile | $2/6*C_{A3} + 2/6*C_{A4} + 1/6*C_{A5} + 1/6*C_{A10}$ | 213 | 191 | 11 |
| | | Column C pile | $1/6*C_{A3} + 3/6*C_{A4} + 1/6*C_{A5} + 1/6*C_{A10}$ | 213 | 202 | 11 |
| | | Column D pile | $1/6*C_{A3} + 2/6*C_{A4} + 2/6*C_{A5} + 1/6*C_{A10}$ | 213 | 213 | 11 |
| | | Column E pile | $1/6*C_{A3} + 1/6*C_{A4} + 3/6*C_{A5} + 1/6*C_{A10}$ | 213 | 223 | 11 |
| | | Column F pile | $1/6*C_{A3} + 1/6*C_{A4} + 2/6*C_{A5} + 2/6*C_{A10}$ | 170 | 223 | 21 |
| | | Column G pile | $1/6*C_{A3} + 1/6*C_{A4} + 1/6*C_{A5} + 3/6*C_{A10}$ | 128 | 223 | 32 |
| | | Column H pile | $2/6*C_{A3} + 1/6*C_{A4} + 1/6*C_{A5} + 2/6*C_{A10}$ | 170 | 202 | 21 |

FIG. 5 shows the application of the RGB values ($R_\xi$, $G_\xi$, $B_\xi$) of the chenille carpet pile $\xi$ corresponding to 6 raw filaments, the application of the 24 base colors, and the design of gradient patterns of color-mixed chenille carpet piles in an embodiment regarding chenille carpet piles with a gradient change in the clear color mixing effect.

The RGB values of the chenille carpet pile with a clear color mixing effect are shown in Table 7.

TABLE 7

| SN | Combinations of colors | Color mixing ratio | | RGB values $\xi(R_\xi, G_\xi, B_\xi)$ of gradient mixed-color pile filaments | | |
|---|---|---|---|---|---|---|
| 1 | $A_1 + A_2 + A_4 + A_{13}$ | Column A pile | $3/6*C_{A1} + 1/6*C_{A2} + 1/6*C_{A4} + 1/6*C_{A13}$ | 213 | 86 | 43 |
| | | Column B pile | $2/6*C_{A1} + 2/6*C_{A2} + 1/6*C_{A4} + 1/6*C_{A13}$ | 213 | 96 | 43 |
| | | Column C pile | $1/6*C_{A1} + 3/6*C_{A2} + 1/6*C_{A4} + 1/6*C_{A13}$ | 213 | 107 | 43 |
| | | Column D pile | $1/6*C_{A1} + 2/6*C_{A2} + 2/6*C_{A4} + 1/6*C_{A13}$ | 213 | 128 | 43 |
| | | Column E pile | $1/6*C_{A1} + 1/6*C_{A2} + 3/6*C_{A4} + 1/6*C_{A13}$ | 213 | 149 | 43 |
| | | Column F pile | $1/6*C_{A1} + 1/6*C_{A2} + 2/6*C_{A4} + 2/6*C_{A13}$ | 170 | 159 | 85 |
| | | Column G pile | $1/6*C_{A1} + 1/6*C_{A2} + 1/6*C_{A4} + 3/6*C_{A13}$ | 128 | 171 | 128 |
| | | Column H pile | $2/6*C_{A1} + 1/6*C_{A2} + 1/6*C_{A4} + 2/6*C_{A13}$ | 170 | 128 | 85 |
| 2 | $A_2 + A_3 + A_5 + A_{14}$ | Column A pile | $3/6*C_{A2} + 1/6*C_{A3} + 1/6*C_{A5} + 1/6*C_{A14}$ | 213 | 128 | 43 |
| | | Column B pile | $2/6*C_{A2} + 2/6*C_{A3} + 1/6*C_{A5} + 1/6*C_{A14}$ | 213 | 138 | 43 |
| | | Column C pile | $1/6*C_{A2} + 3/6*C_{A3} + 1/6*C_{A5} + 1/6*C_{A14}$ | 213 | 149 | 43 |
| | | Column D pile | $1/6*C_{A2} + 2/6*C_{A3} + 2/6*C_{A5} + 1/6*C_{A14}$ | 213 | 170 | 43 |
| | | Column E pile | $1/6*C_{A2} + 1/6*C_{A3} + 3/6*C_{A5} + 1/6*C_{A14}$ | 213 | 191 | 43 |
| | | Column F pile | $1/6*C_{A2} + 1/6*C_{A3} + 2/6*C_{A5} + 2/6*C_{A14}$ | 170 | 180 | 85 |
| | | Column G pile | $1/6*C_{A2} + 1/6*C_{A3} + 1/6*C_{A5} + 3/6*C_{A14}$ | 128 | 170 | 128 |
| | | Column H pile | $2/6*C_{A2} + 1/6*C_{A3} + 1/6*C_{A5} + 2/6*C_{A14}$ | 170 | 149 | 85 |
| 3 | $A_3 + A_4 + A_6 + A_{15}$ | Column A pile | $3/6*C_{A3} + 1/6*C_{A4} + 1/6*C_{A6} + 1/6*C_{A15}$ | 202 | 160 | 43 |
| | | Column B pile | $2/6*C_{A3} + 2/6*C_{A4} + 1/6*C_{A6} + 1/6*C_{A15}$ | 202 | 170 | 43 |
| | | Column C pile | $1/6*C_{A3} + 3/6*C_{A4} + 1/6*C_{A6} + 1/6*C_{A15}$ | 202 | 181 | 43 |
| | | Column D pile | $1/6*C_{A3} + 2/6*C_{A4} + 2/6*C_{A6} + 1/6*C_{A15}$ | 191 | 191 | 43 |
| | | Column E pile | $1/6*C_{A3} + 1/6*C_{A4} + 3/6*C_{A6} + 1/6*C_{A15}$ | 180 | 202 | 43 |
| | | Column F pile | $1/6*C_{A3} + 1/6*C_{A4} + 2/6*C_{A6} + 2/6*C_{A15}$ | 149 | 181 | 85 |
| | | Column G pile | $1/6*C_{A3} + 1/6*C_{A4} + 1/6*C_{A6} + 3/6*C_{A15}$ | 117 | 160 | 128 |
| | | Column H pile | $2/6*C_{A3} + 1/6*C_{A4} + 1/6*C_{A6} + 2/6*C_{A15}$ | 159 | 160 | 85 |

In the above technical solutions, the present disclosure combines raw filaments with different dyeing properties to prepare chenille yarns, and changes the combination modes and ratios of the raw filaments to prepare a four-component chenille carpet pile. The present disclosure realizes the heterochromaticity of the four-component pile through the uneven distribution of different dyes on the four-component raw filaments, and regulates the color difference of the four-component filaments after dyeing to form patterns with hazy, moderate and clear color mixing effects. Different from the additive mixing of color light and the subtractive mixing of pigments, the mixing of different colors dyed on the fibers in the four-component chenille carpet pile is spatial juxtaposition mixing, which will form a non-uniform and constant mixed color. According to the different mixing ratios of the color fibers and the interaction between the fiber hues, a composite color consisting of dominant and secondary hues will be produced. The composite color will blend or separate with different viewing distance, angle, ambient light and other factors, resulting in a dynamic color. The entire design implementation of the present disclosure can effectively improve the efficiency of constructing the pattern of the chenille carpet pile.

Although the embodiments of the present disclosure are described in detail above in conjunction with the drawings, the present disclosure is not limited to the above-described embodiments, and various changes may be made without departing from the spirit of the present disclosure within the knowledge of those skilled in the art.

What is claimed is:

1. A regulation method of dyeing for patterning a four-component chenille carpet pile, comprising the following steps:

step A: providing four types of raw filaments α, β, γ, δ with equal linear densities and different dyeing properties; mixing the four types of the raw filaments α, β, γ, δ to obtain multiple types of pile filaments corresponding to different combinations of a specified number of the raw filaments α, β, γ, δ, forming a four-component chenille carpet pile filament system; and proceeding to step B;

step B: using four preset types of dyes with the different dyeing properties and different base colors that are respectively applicable to the raw filaments α, β, γ, δ to dye the multiple types of the pile filaments corresponding to the different combinations of the specified number of the raw filaments α, β, γ, δ, thereby obtaining dyed raw filaments α, β, γ, δ in the multiple types of the pile filaments respectively; and proceeding to step C;

step C: calculating, based on red, green, and blue (RGB) values ($R_\alpha$, $G_\alpha$, $B_\alpha$), ($R_\beta$, $G_\beta$, $B_\beta$), ($R_\gamma$, $G_\gamma$, $B_\gamma$), and ($R_\delta$, $G_\delta$, $B_\delta$) of the dyed raw filaments α, β, γ, δ in the multiple types of the pile filaments corresponding to the different combinations of the specified number of the raw filaments α, β, γ, δ, RGB values of the multiple types of the pile filaments corresponding to the different combinations of the specified number of the raw filaments α, β, γ, δ, thereby calculating RGB values ($R_\zeta$, $G_\zeta$, $B_\zeta$) of a chenille carpet pile ζ corresponding to the different combinations of the specified number of the raw filaments α, β, γ, δ; and proceeding to step D; and step D: selecting combinations of four base colors with preset hue differences from preset base colors; dyeing, by the combinations of the four base colors, the raw filaments α, β, γ, δ in the multiple types of the pile filaments respectively according to step B to obtain multiple types of mixed-color pile filaments with the preset hue differences; and constructing, according to the RGB values ($R_\zeta$, $G_\zeta$, $B_\zeta$) of the chenille carpet pile ζ corresponding to the different combinations of the specified number of the raw filaments α, β, γ, δ, preset types of chenille carpet piles by tufting the multiple types of the mixed-color pile filaments with the preset hue differences;

selecting combinations of four base colors with a hue difference of less than 60° from the preset base colors; dyeing, by the combinations of the four base colors, the raw filaments α, β, γ, δ in the multiple types of pile filaments respectively according to step B to obtain multiple types of mixed-color pile filaments with the hue difference of less than 60°; and constructing, based on the RGB values ($R_\zeta$, $G_\zeta$, $B_\zeta$) of the chenille carpet pile ζ corresponding to the different combinations of the specified number of the raw filaments α, β, γ, δ, a chenille carpet pile with a hazy color mixing effect by tufting the multiple types of mixed-color pile filaments with the hue difference of less than 60°;

selecting combinations of four base colors with a hue difference of greater than 60° and less than 120° from the preset base colors; dyeing, by the combinations of the four base colors, the raw filaments α, β, γ, δ in the multiple types of pile filaments respectively according to step B to obtain multiple types of mixed-color pile filaments with the hue difference of greater than 60° and less than 120°; and constructing, based on the RGB values ($R_\zeta$, $G_\zeta$, $B_\zeta$) of the chenille carpet pile ζ corresponding to the different combinations of the specified number of the raw filaments α, β, γ, δ, a chenille carpet pile with a moderate color mixing effect by tufting the multiple types of mixed-color pile filaments with the hue difference of greater than 60° and less than 120°; and selecting combinations of four base colors with a hue difference of greater than 120° and less than 180° from the preset base colors, and selecting combinations of three base colors with the hue difference of greater than 120° and less than 180° from the preset base colors to cooperate with white or black to form combinations of four base colors; dyeing, by the combinations of the four base colors, the raw filaments α, β, γ, δ in the multiple types of pile filaments respectively according to step B to obtain multiple types of mixed-color pile filaments with the hue difference of greater than 120° and less than 180° from the preset base colors; and constructing, based on the RGB values ($R_\zeta$, $G_\zeta$, $B_\zeta$) of the chenille carpet pile ζ corresponding to the different combinations of the specified number of the raw filaments α, β, γ, δ, a chenille carpet pile with a clear color mixing effect by tufting the multiple types of mixed-color pile filaments with the hue difference of greater than 120° and less than 180° from the preset base colors.

2. The regulation method of dyeing for patterning the four-component chenille carpet pile according to claim 1, wherein the step A comprises: providing the four types of the raw filaments α, β, γ, δ with the equal linear densities and the different dyeing properties, as shown in Table 1; and

TABLE 1

| | Numbers of raw filaments | | | | | | | | | | | |
|---|---|---|---|---|---|---|---|---|---|---|---|---|
| | 4 filaments | | | | 6 filaments | | | | 8 filaments | | | |
| Combinations | α | β | γ | δ | α | β | γ | δ | α | β | γ | δ |
| 1 | 1/4 | 1/4 | 1/4 | 1/4 | 3/6 | 1/6 | 1/6 | 1/6 | 5/8 | 1/8 | 1/8 | 1/8 |
| 2 | | | | | 2/6 | 2/6 | 1/6 | 1/6 | 4/8 | 2/8 | 1/8 | 1/8 |
| 3 | | | | | 2/6 | 1/6 | 2/6 | 1/6 | 4/8 | 1/8 | 2/8 | 1/8 |
| 4 | | | | | 2/6 | 1/6 | 1/6 | 2/6 | 4/8 | 1/8 | 1/8 | 2/8 |
| 5 | | | | | 1/6 | 3/6 | 1/6 | 1/6 | 3/8 | 3/8 | 1/8 | 1/8 |
| 6 | | | | | 1/6 | 2/6 | 2/6 | 1/6 | 3/8 | 2/8 | 2/8 | 1/8 |
| 7 | | | | | 1/6 | 2/6 | 1/6 | 2/6 | 3/8 | 2/8 | 1/8 | 2/8 |
| 8 | | | | | 1/6 | 1/6 | 3/6 | 1/6 | 3/8 | 1/8 | 3/8 | 1/8 |
| 9 | | | | | 1/6 | 1/6 | 2/6 | 2/6 | 3/8 | 1/8 | 2/8 | 2/8 |
| 10 | | | | | 1/6 | 1/6 | 1/6 | 3/6 | 3/8 | 1/8 | 1/8 | 3/8 |
| 11 | | | | | | | | | 2/8 | 4/8 | 1/8 | 1/8 |

TABLE 1-continued

| | Numbers of raw filaments | | | | | | | | | | | |
|---|---|---|---|---|---|---|---|---|---|---|---|---|
| | 4 filaments | | | | 6 filaments | | | | 8 filaments | | | |
| Combinations | α | β | γ | δ | α | β | γ | δ | α | β | γ | δ |
| 12 | | | | | | | | | 2/8 | 3/8 | 2/8 | 1/8 |
| 13 | | | | | | | | | 2/8 | 3/8 | 1/8 | 2/8 |
| 14 | | | | | | | | | 2/8 | 2/8 | 3/8 | 1/8 |
| 15 | | | | | | | | | 2/8 | 2/8 | 2/8 | 2/8 |
| 16 | | | | | | | | | 2/8 | 2/8 | 1/8 | 3/8 |
| 17 | | | | | | | | | 2/8 | 1/8 | 4/8 | 1/8 |
| 18 | | | | | | | | | 2/8 | 1/8 | 3/8 | 2/8 |
| 19 | | | | | | | | | 2/8 | 1/8 | 2/8 | 3/8 |
| 20 | | | | | | | | | 2/8 | 1/8 | 1/8 | 4/8 |
| 21 | | | | | | | | | 1/8 | 5/8 | 1/8 | 1/8 |
| 22 | | | | | | | | | 1/8 | 4/8 | 2/8 | 1/8 |
| 23 | | | | | | | | | 1/8 | 4/8 | 1/8 | 2/8 |
| 24 | | | | | | | | | 1/8 | 3/8 | 3/8 | 1/8 |
| 25 | | | | | | | | | 1/8 | 3/8 | 2/8 | 2/8 |
| 26 | | | | | | | | | 1/8 | 3/8 | 1/8 | 3/8 |
| 27 | | | | | | | | | 1/8 | 2/8 | 4/8 | 1/8 |
| 28 | | | | | | | | | 1/8 | 2/8 | 3/8 | 2/8 |

TABLE 1-continued

| | Numbers of raw filaments | | | | | | | | | | | |
|---|---|---|---|---|---|---|---|---|---|---|---|---|
| | 4 filaments | | | | 6 filaments | | | | 8 filaments | | | |
| Combinations | α | β | γ | δ | α | β | γ | δ | α | β | γ | δ |
| 29 | | | | | | | | | 1/8 | 2/8 | 2/8 | 3/8 |
| 30 | | | | | | | | | 1/8 | 2/8 | 1/8 | 4/8 |
| 31 | | | | | | | | | 1/8 | 1/8 | 5/8 | 1/8 |
| 32 | | | | | | | | | 1/8 | 1/8 | 4/8 | 2/8 |
| 33 | | | | | | | | | 1/8 | 1/8 | 3/8 | 3/8 |
| 34 | | | | | | | | | 1/8 | 1/8 | 2/8 | 4/8 |
| 35 | | | | | | | | | 1/8 | 1/8 | 1/8 | 5/8 |

mixing the four types of the raw filaments α, β, γ, δ to obtain the pile filaments with the different combinations of the specified number of the raw filaments α, β, γ, δ, and forming the four-component chenille carpet pile filament system.

3. The regulation method of dyeing for patterning the four-component chenille carpet pile according to claim 1, wherein the step C comprises: based on Table 2,

TABLE 2

| | RGB values after combination | | |
|---|---|---|---|
| Combinations | $R_\xi$ | $G_\xi$ | $B_\xi$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |

calculating the RGB values ($R_\zeta$, $G_\zeta$, $B_\zeta$) of the chenille carpet pile ζ corresponding to the different combinations of the four raw filaments α, β, γ, δ.

4. The regulation method of dyeing for patterning the four-component chenille carpet pile according to claim 1, wherein the step C comprises: based on Table 3,

TABLE 3

| | RGB values after combination | | |
|---|---|---|---|
| Combinations | $R_\xi$ | $G_\xi$ | $B_\xi$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 2α + 2β + 1γ + 1δ | $\frac{2}{6}*R_\alpha+\frac{2}{6}*R_\beta+\frac{1}{6}*R_\gamma+\frac{1}{6}*R_\delta$ | $\frac{2}{6}*G_\alpha+\frac{2}{6}*G_\beta+\frac{1}{6}*G_\gamma+\frac{1}{6}*G_\delta$ | $\frac{2}{6}*B_\alpha+\frac{2}{6}*B_\beta+\frac{1}{6}*B_\gamma+\frac{1}{6}*B_\delta$ |
| 2α + 1β + 2γ + 1δ | $\frac{2}{6}*R_\alpha+\frac{1}{6}*R_\beta+\frac{2}{6}*R_\gamma+\frac{1}{6}*R_\delta$ | $\frac{2}{6}*G_\alpha+\frac{1}{6}*G_\beta+\frac{2}{6}*G_\gamma+\frac{1}{6}*G_\delta$ | $\frac{2}{6}*B_\alpha+\frac{1}{6}*B_\beta+\frac{2}{6}*B_\gamma+\frac{1}{6}*B_\delta$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 1α + 2β + 2γ + 1δ | $\frac{1}{6}*R_\alpha+\frac{2}{6}*R_\beta+\frac{2}{6}*R_\gamma+\frac{1}{6}*R_\delta$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 2β + 1γ + 2δ | $\frac{1}{6}*R_\alpha+\frac{2}{6}*R_\beta+\frac{1}{6}*R_\gamma+\frac{2}{6}*R_\delta$ | $\frac{1}{6}*G_\alpha+\frac{2}{6}*G_\beta+\frac{1}{6}*G_\gamma+\frac{2}{6}*G_\delta$ | $\frac{1}{6}*B_\alpha+\frac{2}{6}*B_\beta+\frac{1}{6}*B_\gamma+\frac{2}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1α + 1β + 2γ + 2δ | $\frac{1}{6}*R_\alpha+\frac{1}{6}*R_\beta+\frac{2}{6}*R_\gamma+\frac{2}{6}*R_\delta$ | $\frac{1}{6}*G_\alpha+\frac{1}{6}*G_\beta+\frac{2}{6}*G_\gamma+\frac{2}{6}*G_\delta$ | $\frac{1}{6}*B_\alpha+\frac{1}{6}*B_\beta+\frac{2}{6}*B_\gamma+\frac{1}{6}*B_\delta$ |

TABLE 3-continued

| Combinations | RGB values after combination | | |
|---|---|---|---|
| | $R_\xi$ | $G_\xi$ | $B_\xi$ |
| $1\alpha + 1\beta + 1\gamma + 3\delta$ | $\frac{1}{6}*R_\alpha + \frac{1}{6}*R_\beta + \frac{1}{6}*R_\gamma + \frac{3}{6}*R_\delta$ | $\frac{1}{6}*G_\alpha + \frac{1}{6}*G_\beta + \frac{1}{6}*G_\gamma + \frac{3}{6}*G_\delta$ | $\frac{1}{6}*B_\alpha + \frac{1}{6}*B_\beta + \frac{1}{6}*B_\gamma + \frac{3}{6}*B_\delta$ |

calculating the RGB values ($R_\zeta$, $G_\zeta$, $B_\zeta$) of the chenille carpet pile ζ corresponding to different combinations of six raw filaments α, β, γ, δ.

5. The regulation method of dyeing for patterning the four-component chenille carpet pile according to claim 1, wherein the step C comprises: based on Table 4,

TABLE 4

| Combinations | RGB values after combination | | |
|---|---|---|---|
| | $R_\xi$ | $G_\xi$ | $B_\xi$ |
| $5\alpha + 1\beta + 1\gamma + 1\delta$ | $\frac{5}{8}*R_\alpha + \frac{1}{8}*R_\beta + \frac{1}{8}*R_\gamma + \frac{1}{8}*R_\delta$ | $\frac{5}{8}*G_\alpha + \frac{1}{8}*G_\beta + \frac{1}{8}*G_\gamma + \frac{1}{8}*G_\delta$ | $\frac{5}{8}*B_\alpha + \frac{1}{8}*B_\beta + \frac{1}{8}*B_\gamma + \frac{1}{8}*B_\delta$ |
| $4\alpha + 2\beta + 1\gamma + 1\delta$ | $\frac{4}{8}*R_\alpha + \frac{2}{8}*R_\beta + \frac{1}{8}*R_\gamma + \frac{1}{8}*R_\delta$ | $\frac{4}{8}*G_\alpha + \frac{2}{8}*G_\beta + \frac{1}{8}*G_\gamma + \frac{1}{8}*G_\delta$ | $\frac{4}{8}*B_\alpha + \frac{2}{8}*B_\beta + \frac{1}{8}*B_\gamma + \frac{1}{8}*B_\delta$ |
| $4\alpha + 1\beta + 2\gamma + 1\delta$ | $\frac{4}{8}*R_\alpha + \frac{1}{8}*R_\beta + \frac{2}{8}*R_\gamma + \frac{1}{8}*R_\delta$ | $\frac{4}{8}*G_\alpha + \frac{1}{8}*G_\beta + \frac{2}{8}*G_\gamma + \frac{1}{8}*G_\delta$ | $\frac{4}{8}*B_\alpha + \frac{1}{8}*B_\beta + \frac{2}{8}*B_\gamma + \frac{1}{8}*B_\delta$ |
| $4\alpha + 1\beta + 1\gamma + 2\delta$ | $\frac{4}{8}*R_\alpha + \frac{1}{8}*R_\beta + \frac{1}{8}*R_\gamma + \frac{2}{8}*R_\delta$ | $\frac{4}{8}*G_\alpha + \frac{1}{8}*G_\beta + \frac{1}{8}*G_\gamma + \frac{2}{8}*G_\delta$ | $\frac{4}{8}*B_\alpha + \frac{1}{8}*B_\beta + \frac{1}{8}*B_\gamma + \frac{2}{8}*B_\delta$ |
| $3\alpha + 3\beta + 1\gamma + 1\delta$ | $\frac{3}{8}*R_\alpha + \frac{3}{8}*R_\beta + \frac{1}{8}*R_\gamma + \frac{1}{8}*R_\delta$ | $\frac{3}{8}*G_\alpha + \frac{3}{8}*G_\beta + \frac{1}{8}*G_\gamma + \frac{1}{8}*G_\delta$ | $\frac{3}{8}*B_\alpha + \frac{3}{8}*B_\beta + \frac{1}{8}*B_\gamma + \frac{1}{8}*B_\delta$ |
| $3\alpha + 2\beta + 2\gamma + 1\delta$ | $\frac{3}{8}*R_\alpha + \frac{2}{8}*R_\beta + \frac{2}{8}*R_\gamma + \frac{1}{8}*R_\delta$ | $\frac{3}{8}*G_\alpha + \frac{2}{8}*G_\beta + \frac{2}{8}*G_\gamma + \frac{1}{8}*G_\delta$ | $\frac{3}{8}*B_\alpha + \frac{2}{8}*B_\beta + \frac{2}{8}*B_\gamma + \frac{1}{8}*B_\delta$ |
| $3\alpha + 2\beta + 1\gamma + 2\delta$ | $\frac{3}{8}*R_\alpha + \frac{2}{8}*R_\beta + \frac{1}{8}*R_\gamma + \frac{2}{8}*R_\delta$ | $\frac{3}{8}*G_\alpha + \frac{2}{8}*G_\beta + \frac{1}{8}*G_\gamma + \frac{2}{8}*G_\delta$ | $\frac{3}{8}*B_\alpha + \frac{2}{8}*B_\beta + \frac{1}{8}*B_\gamma + \frac{2}{8}*B_\delta$ |
| $3\alpha + 1\beta + 3\gamma + 1\delta$ | $\frac{3}{8}*R_\alpha + \frac{1}{8}*R_\beta + \frac{3}{8}*R_\gamma + \frac{1}{8}*R_\delta$ | $\frac{3}{8}*G_\alpha + \frac{1}{8}*G_\beta + \frac{3}{8}*G_\gamma + \frac{1}{8}*G_\delta$ | $\frac{3}{8}*B_\alpha + \frac{1}{8}*B_\beta + \frac{3}{8}*B_\gamma + \frac{1}{8}*B_\delta$ |
| $3\alpha + 1\beta + 2\gamma + 2\delta$ | $\frac{3}{8}*R_\alpha + \frac{1}{8}*R_\beta + \frac{2}{8}*R_\gamma + \frac{2}{8}*R_\delta$ | $\frac{3}{8}*G_\alpha + \frac{1}{8}*G_\beta + \frac{2}{8}*G_\gamma + \frac{2}{8}*G_\delta$ | $\frac{3}{8}*B_\alpha + \frac{1}{8}*B_\beta + \frac{2}{8}*B_\gamma + \frac{2}{8}*B_\delta$ |
| $3\alpha + 1\beta + 1\gamma + 3\delta$ | $\frac{3}{8}*R_\alpha + \frac{1}{8}*R_\beta + \frac{1}{8}*R_\gamma + \frac{3}{8}*R_\delta$ | $\frac{3}{8}*G_\alpha + \frac{1}{8}*G_\beta + \frac{1}{8}*G_\gamma + \frac{3}{8}*G_\delta$ | $\frac{3}{8}*B_\alpha + \frac{1}{8}*B_\beta + \frac{1}{8}*B_\gamma + \frac{3}{8}*B_\delta$ |
| $2\alpha + 4\beta + 1\gamma + 1\delta$ | $\frac{2}{8}*R_\alpha + \frac{4}{8}*R_\beta + \frac{1}{8}*R_\gamma + \frac{1}{8}*R_\delta$ | $\frac{2}{8}*G_\alpha + \frac{4}{8}*G_\beta + \frac{1}{8}*G_\gamma + \frac{1}{8}*G_\delta$ | $\frac{2}{8}*B_\alpha + \frac{4}{8}*B_\beta + \frac{1}{8}*B_\gamma + \frac{1}{8}*B_\delta$ |
| $2\alpha + 3\beta + 2\gamma + 1\delta$ | $\frac{2}{8}*R_\alpha + \frac{3}{8}*R_\beta + \frac{2}{8}*R_\gamma + \frac{1}{8}*R_\delta$ | $\frac{2}{8}*G_\alpha + \frac{3}{8}*G_\beta + \frac{2}{8}*G_\gamma + \frac{1}{8}*G_\delta$ | $\frac{2}{8}*B_\alpha + \frac{3}{8}*B_\beta + \frac{2}{8}*B_\gamma + \frac{1}{8}*B_\delta$ |
| $2\alpha + 3\beta + 1\gamma + 2\delta$ | $\frac{2}{8}*R_\alpha + \frac{3}{8}*R_\beta + \frac{1}{8}*R_\gamma + \frac{2}{8}*R_\delta$ | $\frac{2}{8}*G_\alpha + \frac{3}{8}*G_\beta + \frac{1}{8}*G_\gamma + \frac{2}{8}*G_\delta$ | $\frac{2}{8}*B_\alpha + \frac{3}{8}*B_\beta + \frac{1}{8}*B_\gamma + \frac{2}{8}*B_\delta$ |
| $2\alpha + 2\beta + 3\gamma + 1\delta$ | $\frac{2}{8}*R_\alpha + \frac{2}{8}*R_\beta + \frac{3}{8}*R_\gamma + \frac{1}{8}*R_\delta$ | $\frac{2}{8}*G_\alpha + \frac{2}{8}*G_\beta + \frac{3}{8}*G_\gamma + \frac{1}{8}*G_\delta$ | $\frac{2}{8}*B_\alpha + \frac{2}{8}*B_\beta + \frac{3}{8}*B_\gamma + \frac{1}{8}*B_\delta$ |
| $2\alpha + 2\beta + 2\gamma + 2\delta$ | $\frac{2}{8}*R_\alpha + \frac{2}{8}*R_\beta + \frac{2}{8}*R_\gamma + \frac{2}{8}*R_\delta$ | $\frac{2}{8}*G_\alpha + \frac{2}{8}*G_\beta + \frac{2}{8}*G_\gamma + \frac{2}{8}*G_\delta$ | $\frac{2}{8}*B_\alpha + \frac{2}{8}*B_\beta + \frac{2}{8}*B_\gamma + \frac{2}{8}*B_\delta$ |
| $2\alpha + 2\beta + 1\gamma + 3\delta$ | $\frac{2}{8}*R_\alpha + \frac{2}{8}*R_\beta + \frac{1}{8}*R_\gamma + \frac{3}{8}*R_\delta$ | $\frac{2}{8}*G_\alpha + \frac{2}{8}*G_\beta + \frac{1}{8}*G_\gamma + \frac{3}{8}*G_\delta$ | $\frac{2}{8}*B_\alpha + \frac{2}{8}*B_\beta + \frac{1}{8}*B_\gamma + \frac{3}{8}*B_\delta$ |
| $2\alpha + 1\beta + 4\gamma + 1\delta$ | $\frac{2}{8}*R_\alpha + \frac{1}{8}*R_\beta + \frac{4}{8}*R_\gamma + \frac{1}{8}*R_\delta$ | $\frac{2}{8}*G_\alpha + \frac{1}{8}*G_\beta + \frac{4}{8}*G_\gamma + \frac{1}{8}*G_\delta$ | $\frac{2}{8}*B_\alpha + \frac{1}{8}*B_\beta + \frac{4}{8}*B_\gamma + \frac{1}{8}*B_\delta$ |
| $2\alpha + 1\beta + 3\gamma + 2\delta$ | $\frac{2}{8}*R_\alpha + \frac{1}{8}*R_\beta + \frac{3}{8}*R_\gamma + \frac{2}{8}*R_\delta$ | $\frac{2}{8}*G_\alpha + \frac{1}{8}*G_\beta + \frac{3}{8}*G_\gamma + \frac{2}{8}*G_\delta$ | $\frac{2}{8}*B_\alpha + \frac{1}{8}*B_\beta + \frac{3}{8}*B_\gamma + \frac{2}{8}*B_\delta$ |

TABLE 4-continued

| Combinations | RGB values after combination | | |
|---|---|---|---|
| | $R_\xi$ | $G_\xi$ | $B_\xi$ |
| $2\alpha + 1\beta + 2\gamma + 3\delta$ | $\frac{2}{8}*R_\alpha + \frac{1}{8}*R_\beta + \frac{2}{8}*R_\gamma + \frac{3}{8}*R_\delta$ | $\frac{2}{8}*G_\alpha + \frac{1}{8}*G_\beta + \frac{2}{8}*G_\gamma + \frac{3}{8}*G_\delta$ | $\frac{2}{8}*B_\alpha + \frac{1}{8}*B_\beta + \frac{2}{8}*B_\gamma + \frac{3}{8}*B_\delta$ |
| $2\alpha + 1\beta + 1\gamma + 4\delta$ | $\frac{2}{8}*R_\alpha + \frac{1}{8}*R_\beta + \frac{1}{8}*R_\gamma + \frac{4}{8}*R_\delta$ | $\frac{2}{8}*G_\alpha + \frac{1}{8}*G_\beta + \frac{1}{8}*G_\gamma + \frac{4}{8}*G_\delta$ | $\frac{2}{8}*B_\alpha + \frac{1}{8}*B_\beta + \frac{1}{8}*B_\gamma + \frac{4}{8}*B_\delta$ |
| $1\alpha + 5\beta + 1\gamma + 1\delta$ | $\frac{1}{8}*R_\alpha + \frac{5}{8}*R_\beta + \frac{1}{8}*R_\gamma + \frac{1}{8}*R_\delta$ | $\frac{1}{8}*G_\alpha + \frac{5}{8}*G_\beta + \frac{1}{8}*G_\gamma + \frac{1}{8}*G_\delta$ | $\frac{1}{8}*B_\alpha + \frac{5}{8}*B_\beta + \frac{1}{8}*B_\gamma + \frac{1}{8}*B_\delta$ |
| $1\alpha + 4\beta + 2\gamma + 1\delta$ | $\frac{1}{8}*R_\alpha + \frac{4}{8}*R_\beta + \frac{2}{8}*R_\gamma + \frac{1}{8}*R_\delta$ | $\frac{1}{8}*G_\alpha + \frac{4}{8}*G_\beta + \frac{2}{8}*G_\gamma + \frac{1}{8}*G_\delta$ | $\frac{1}{8}*B_\alpha + \frac{4}{8}*B_\beta + \frac{2}{8}*B_\gamma + \frac{1}{8}*B_\delta$ |
| $1\alpha + 4\beta + 1\gamma + 2\delta$ | $\frac{1}{8}*R_\alpha + \frac{4}{8}*R_\beta + \frac{1}{8}*R_\gamma + \frac{2}{8}*R_\delta$ | $\frac{1}{8}*G_\alpha + \frac{4}{8}*G_\beta + \frac{1}{8}*G_\gamma + \frac{2}{8}*G_\delta$ | $\frac{1}{8}*B_\alpha + \frac{4}{8}*B_\beta + \frac{1}{8}*B_\gamma + \frac{2}{8}*B_\delta$ |
| $1\alpha + 3\beta + 3\gamma + 1\delta$ | $\frac{1}{8}*R_\alpha + \frac{3}{8}*R_\beta + \frac{3}{8}*R_\gamma + \frac{1}{8}*R_\delta$ | $\frac{1}{8}*G_\alpha + \frac{3}{8}*G_\beta + \frac{3}{8}*G_\gamma + \frac{1}{8}*G_\delta$ | $\frac{1}{8}*B_\alpha + \frac{3}{8}*B_\beta + \frac{3}{8}*B_\gamma + \frac{1}{8}*B_\delta$ |
| $1\alpha + 3\beta + 2\gamma + 2\delta$ | $\frac{1}{8}*R_\alpha + \frac{3}{8}*R_\beta + \frac{2}{8}*R_\gamma + \frac{2}{8}*R_\delta$ | $\frac{1}{8}*G_\alpha + \frac{3}{8}*G_\beta + \frac{2}{8}*G_\gamma + \frac{2}{8}*G_\delta$ | $\frac{1}{8}*B_\alpha + \frac{3}{8}*B_\beta + \frac{2}{8}*B_\gamma + \frac{2}{8}*B_\delta$ |
| $1\alpha + 3\beta + 1\gamma + 3\delta$ | $\frac{1}{8}*R_\alpha + \frac{3}{8}*R_\beta + \frac{1}{8}*R_\gamma + \frac{3}{8}*R_\delta$ | $\frac{1}{8}*G_\alpha + \frac{3}{8}*G_\beta + \frac{1}{8}*G_\gamma + \frac{3}{8}*G_6$ | $\frac{1}{8}*B_\alpha + \frac{3}{8}*B_\beta + \frac{1}{8}*B_\gamma + \frac{3}{8}*B_\delta$ |
| $1\alpha + 2\beta + 4\gamma + 1\delta$ | $\frac{1}{8}*R_\alpha + \frac{2}{8}*R_\beta + \frac{4}{8}*R_\gamma + \frac{1}{8}*R_\delta$ | $\frac{1}{8}*G_\alpha + \frac{2}{8}*G_\beta + \frac{4}{8}*G_\gamma + \frac{1}{8}*G_\delta$ | $\frac{1}{8}*B_\alpha + \frac{2}{8}*B_\beta + \frac{4}{8}*B_\gamma + \frac{1}{8}*B_\delta$ |
| $1\alpha + 2\beta + 3\gamma + 2\delta$ | $\frac{1}{8}*R_\alpha + \frac{2}{8}*R_\beta + \frac{3}{8}*R_\gamma + \frac{2}{8}*R_\delta$ | $\frac{1}{8}*G_\alpha + \frac{2}{8}*G_\beta + \frac{3}{8}*G_\gamma + \frac{2}{8}*G_\delta$ | $\frac{1}{8}*B_\alpha + \frac{2}{8}*B_\beta + \frac{3}{8}*B_\gamma + \frac{2}{8}*B_\delta$ |
| $1\alpha + 2\beta + 2\gamma + 3\delta$ | $\frac{1}{8}*R_\alpha + \frac{2}{8}*R_\beta + \frac{2}{8}*R_\gamma + \frac{3}{8}*R_\delta$ | $\frac{1}{8}*G_\alpha + \frac{2}{8}*G_\beta + \frac{2}{8}*G_\gamma + \frac{3}{8}*G_\delta$ | $\frac{1}{8}*B_\alpha + \frac{2}{8}*B_\beta + \frac{2}{8}*B_\gamma + \frac{3}{8}*B_\delta$ |
| $1\alpha + 2\beta + 1\gamma + 4\delta$ | $\frac{1}{8}*R_\alpha + \frac{2}{8}*R_\beta + \frac{1}{8}*R_\gamma + \frac{4}{8}*R_\delta$ | $\frac{1}{8}*G_\alpha + \frac{2}{8}*G_\beta + \frac{1}{8}*G_\gamma + \frac{4}{8}*G_\delta$ | $\frac{1}{8}*B_\alpha + \frac{2}{8}*B_\beta + \frac{1}{8}*B_\gamma + \frac{4}{8}*B_\delta$ |
| $1\alpha + 1\beta + 5\gamma + 1\delta$ | $\frac{1}{8}*R_\alpha + \frac{1}{8}*R_\beta + \frac{5}{8}*R_\gamma + \frac{1}{8}*R_\delta$ | $\frac{1}{8}*G_\alpha + \frac{1}{8}*G_\beta + \frac{5}{8}*G_\gamma + \frac{1}{8}*G_\delta$ | $\frac{1}{8}*B_\alpha + \frac{1}{8}*B_\beta + \frac{5}{8}*B_\gamma + \frac{1}{8}*B_\delta$ |
| $1\alpha + 1\beta + 4\gamma + 2\delta$ | $\frac{1}{8}*R_\alpha + \frac{1}{8}*R_\beta + \frac{4}{8}*R_\gamma + \frac{2}{8}*R_\delta$ | $\frac{1}{8}*G_\alpha + \frac{1}{8}*G_\beta + \frac{4}{8}*G_\gamma + \frac{2}{8}*G_\delta$ | $\frac{1}{8}*B_\alpha + \frac{1}{8}*B_\beta + \frac{4}{8}*B_\gamma + \frac{2}{8}*B_\delta$ |
| $1\alpha + 1\beta + 3\gamma + 3\delta$ | $\frac{1}{8}*R_\alpha + \frac{1}{8}*R_\beta + \frac{3}{8}*R_\gamma + \frac{3}{8}*R_\delta$ | $\frac{1}{8}*G_\alpha + \frac{1}{8}*G_\beta + \frac{3}{8}*G_\gamma + \frac{3}{8}*G_\delta$ | $\frac{1}{8}*B_\alpha + \frac{1}{8}*B_\beta + \frac{3}{8}*B_\gamma + \frac{3}{8}*B_\delta$ |
| $1\alpha + 1\beta + 2\gamma + 4\delta$ | $\frac{1}{8}*R_\alpha + \frac{1}{8}*R_\beta + \frac{2}{8}*R_\gamma + \frac{4}{8}*R_\delta$ | $\frac{1}{8}*G_\alpha + \frac{1}{8}*G_\beta + \frac{2}{8}*G_\gamma + \frac{4}{8}*G_\delta$ | $\frac{1}{8}*B_\alpha + \frac{1}{8}*B_\beta + \frac{2}{8}*B_\gamma + \frac{4}{8}*B_\delta$ |
| $1\alpha + 1\beta + 1\gamma + 5\delta$ | $\frac{1}{8}*R_\alpha + \frac{1}{8}*R_\beta + \frac{1}{8}*R_\gamma + \frac{5}{8}*R_\delta$ | $\frac{1}{8}*G_\alpha + \frac{1}{8}*G_\beta + \frac{1}{8}*G_\gamma + \frac{5}{8}*G_\delta$ | $\frac{1}{8}*B_\alpha + \frac{1}{8}*B_\beta + \frac{1}{8}*B_\gamma + \frac{5}{8}*B_\delta$ |

calculating the RGB values ($R_\zeta$, $G_\zeta$, $B_\zeta$) of the chenille carpet pile $\zeta$ corresponding to different combinations of eight raw filaments $\alpha$, $\beta$, $\gamma$, $\delta$.

* * * * *